US009829854B2

(12) United States Patent
Sato et al.

(10) Patent No.: US 9,829,854 B2
(45) Date of Patent: Nov. 28, 2017

(54) OPENING/CLOSING MECHANISM, POWDER TRANSPORT DEVICE USING THE SAME, AND POWDER PROCESSING APPARATUS

(71) Applicant: FUJI XEROX CO., LTD., Minato-ku, Tokyo (JP)

(72) Inventors: Koichi Sato, Kanagawa (JP); Yoshiyuki Takashima, Kanagawa (JP); Hibiki Sasaki, Kanagawa (JP); Tadashi Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/214,614

(22) Filed: Jul. 20, 2016

(65) Prior Publication Data

US 2017/0285565 A1 Oct. 5, 2017

(30) Foreign Application Priority Data

Mar. 29, 2016 (JP) ..... 2016-064908

(51) Int. Cl.
*G03G 21/16* (2006.01)
*G03G 15/08* (2006.01)

(52) U.S. Cl.
CPC ..... *G03G 21/1676* (2013.01); *G03G 15/0886* (2013.01); *G03G 2215/067* (2013.01); *G03G 2215/0692* (2013.01)

(58) Field of Classification Search
CPC ..... G03G 21/1676; G03G 2215/067; G03G 2215/0692; G03G 15/0886
See application file for complete search history.

(56) References Cited

U.S. PATENT DOCUMENTS 8,391,753 B2 * 3/2013 Takashima ..... G03G 15/0872 399/110
2008/0181673 A1 * 7/2008 Kim ..... G03G 15/0855 399/258
2010/0129118 A1 * 5/2010 Kimura ..... G03G 15/0872 399/260
2015/0063866 A1 * 3/2015 Kang ..... G03G 15/0877 399/113

FOREIGN PATENT DOCUMENTS

JP 2015-118269 A 6/2015

* cited by examiner

*Primary Examiner* — Rodney Bonnette
(74) *Attorney, Agent, or Firm* — Sughrue Mion, PLLC

(57) ABSTRACT

An opening/closing mechanism is provided between a powder transport container removably attached to an apparatus housing and a powder receiving container provided in the apparatus housing to receive powder in the powder transport container as a result of a connection port communicating with a discharging port of the powder transport container. The opening/closing mechanism opens and closes the discharging port along with attachment and detachment of the powder transport container, and includes an opening/closing lid that opens the discharging port by being stopped by a part of the powder receiving container when the powder transport container is attached to the apparatus housing, a seal member, and a covering material that is provided on a surface of the opening/closing lid opposed to the seal member and has a protruding piece in contact with an edge portion of the connection port when the powder transport container is attached.

5 Claims, 22 Drawing Sheets

OPENING/CLOSING MECHANISM, POWDER TRANSPORT DEVICE USING THE SAME, AND POWDER PROCESSING APPARATUS

CROSS-REFERENCE TO RELATED APPLICATIONS

This application is based on and claims priority under 35 USC 119 from Japanese Patent Application No. 2016-064908 filed Mar. 29, 2016.

BACKGROUND

Technical Field

The present invention relates to an opening/closing mechanism that opens and closes a discharging port of a powder transport container, a powder transport device using the opening/closing mechanism, and a powder processing apparatus.

SUMMARY

According to an aspect of the invention, there is provided an opening/closing mechanism provided between a powder transport container that is removably attached to an apparatus housing of a powder processing apparatus including a powder processing unit, has a discharging port opening downward, and transports powder toward the discharging port and a powder receiving container that is provided in the apparatus housing, has a connection port opening upward, and receives the powder in the powder transport container dropped as a result of the connection port communicating with the discharging port. The opening/closing mechanism opens and closes the discharging port along with attachment and detachment of the powder transport container, and includes an opening/closing lid that opens and closes the discharging port while being held to linearly move along an edge of the discharging port and opens the discharging port by being stopped by a part of the powder receiving container when the powder transport container is attached to the apparatus housing, a seal member formed of an elastically deformable elastic material in a peripheral edge portion of the discharging port to seal a gap between the seal member and the opening/closing lid, and a covering material that is provided on a surface of the opening/closing lid opposed to the seal member and has a surface smoother than at least a surface of the seal member. The covering material has a protruding piece that protrudes from the opening/closing lid toward the connection port of the powder receiving container and is disposed so as to be in contact with an edge portion of the connection port when the powder transport container is attached to the apparatus housing.

BRIEF DESCRIPTION OF THE DRAWINGS

Exemplary embodiments of the present invention will be described in detail based on the following figures, wherein:

FIG. 1A is an explanatory view illustrating a state in which the opening/closing mechanism in the powder transport container is closed, FIG. 1B is an explanatory view illustrating the relationship between the opening/closing mechanism and an edge portion of a connection port in a powder receiving container when the powder transport container is attached to an apparatus housing, FIG. 1C is an explanatory view illustrating a state in which the opening/closing mechanism is opened and communicates with the connection port in the powder receiving container when attachment of the powder transport container to the apparatus housing is completed, and FIG. 1D is an explanatory view illustrating the behavior of the opening/closing mechanism when the powder transport container is detached from the apparatus housing;

DETAILED DESCRIPTION

Outline of Exemplary Embodiment

Figure 1A:
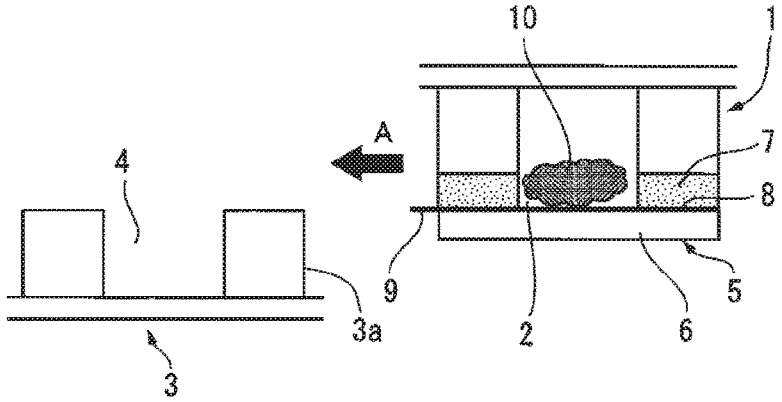
FIGS. 1A to 1D are explanatory views illustrating an outline of an opening/closing mechanism that opens and closes a discharging port of a powder transport container according to an exemplary embodiment of the present invention.

In an exemplary embodiment, as illustrated in FIG. 1A, a powder processing apparatus includes a powder transport container 1, a powder receiving container 3, and an opening/closing mechanism 5. The powder transport container 1 is removably attached to an apparatus housing (not illustrated), has a discharging port 2 opening downward, and transports powder 10 toward the discharging port 2. The powder receiving container 3 is provided in the apparatus housing, has a connection port 4 opening upward, and receives the powder 10 in the powder transport container 1 dropped as a result of the connection port 4 communicating with the discharging port 2. The opening/closing mechanism 5 opens and closes the discharging port 2 along with attachment and detachment of the powder transport container 1.

Here, the powder processing apparatus may be appropriately selected as long as it includes a powder processing unit that processes the powder 10 (for example, an image forming unit that visualizes an electrostatic latent image by using developer serving as powder).

The powder transport container 1 may be appropriately selected as long as it transports the powder 10 to be processed in the powder processing unit (regardless of which or not the powder 10 is to be supplied or collected). The powder receiving container 3 is widely applied as long as it receives the powder 10 from the powder transport container 1 through the connection port 4. In general, a transport member for transporting the powder 10 is provided inside the powder transport container 1, and constitutes a powder transport device together with the powder transport container 1 and the opening/closing mechanism 5.

Further, it is assumed that the powder transport container 1 is removably attached to the apparatus housing, and it is only necessary that the opening/closing mechanism 5 should open and close the discharging port 2 when the powder transport container 1 is attached and detached. At this time, in a method often used to attach and detach the powder transport container 1, for example, a hinge portion is provided in a lower part of the powder transport container 1, and the powder transport container 1 is pivoted on the hinge portion from the user operation side (for example, front side) toward the apparatus housing with the hinge portion being caught in a hinge receiving portion provided in the apparatus housing. The attaching and detaching method is not limited thereto. The powder transport container 1 may be linearly pushed in from the user operation side (for example, front side) along a guide portion in the apparatus housing.

In the exemplary embodiment, it is assumed that the discharging port 2 of the powder transport container 1 opens downward. Hence, when the discharging port 2 is opened and closed by the opening/closing mechanism 5, the powder 10 is apt to fall. Further, it is only necessary that the powder receiving container 3 should be provided in the apparatus body, and may be removably provided or may be fixed. It is also only necessary that the powder receiving container 3 should have the connection port 4 opposed to the discharging port 2 and opening upward.

In particular, in the exemplary embodiment, as illustrated in FIG. 1A, the opening/closing mechanism 5 includes an opening/closing lid 6, a seal member 7, and a covering material 8. The opening/closing lid 6 opens and closes the discharging port 2 of the powder transport container 1 while being held to linearly move along an edge of the discharging port 2, and opens the discharging port 2 by being stopped by a part of the powder receiving container 3 when the powder transport container 1 is attached to the apparatus housing. The seal member 7 is formed by making a peripheral edge portion of the discharging port 2 of an elastically deformable elastic material to seal a gap between the seal member 7 and the opening/closing lid 6. The covering material 8 is provided on a surface of the opening/closing lid 6 opposed to the seal member 7, and has a surface smoother than at least a surface of the seal member 7. The covering material 8 has a protruding piece 9 that protrudes from the opening/closing lid 6 toward the connection port 4 of the powder receiving container 3 and is disposed in contact with an edge portion of the connection port 4 when the powder transport container 1 is attached to the apparatus housing.

In the exemplary embodiment, when the powder transport container 1 is attached to the apparatus housing, the opening/closing lid 6 moves and is stopped by a part of the powder receiving container 3 so that the discharging port 2 of the opening/closing mechanism 5 communicates with the connection port 4 of the powder receiving container 3.

The seal member 7 seals the space between the seal member 7 and the opening/closing lid 6 to prevent formation of a gap therebetween.

Further, while Mylar (trademark, polyester film) is given as an example of the covering material 8, the material is not limited thereto, and may be appropriately selected.

Here, since the covering material 8 has a surface smoother than a surface of the seal member 7, the powder 10 on the covering material 8 is scraped off by the surface of the seal member 7. Further, when the powder transport container 1 is attached to the apparatus housing, the protruding piece 9 of the covering material 8 is placed on the edge portion of the connection port 4 in the powder receiving container 3 to close a gap under the discharging port 2 in an operation process in which the discharging port 2 communicates with the connection port 4.

Therefore, supposing that the powder transport container 1 is attached to the apparatus housing, as illustrated in FIG. 1A, the powder transport container 1 moves in a direction of arrow A toward a predetermined attachment position in the apparatus body. Then, in the opening/closing mechanism 5 of the powder transport container 1, the opening/closing lid 6 first collides with and is stopped by a part of the powder receiving container 3 near the connection port 4 (a side wall 3*a* of the powder receiving container 3 in the exemplary embodiment). In this state, since the side of the opening/closing lid 6 opposed to the seal member 7 is covered with the covering material 8 and the covering material 8 has the protruding piece 9 protruding from the opening/closing lid 6 toward the connection port 4, when the opening/closing lid 6 is stopped by the side wall 3*a* of the powder receiving container 3, the protruding piece 9 of the covering material 8 is disposed in contact with the edge portion of the connection port 4 in the powder receiving container 3. At this time, even when there is a minute gap in a contact portion between the opening/closing lid 6 and the side wall 3*a* of the powder receiving container 3, the gap is closed by the protruding piece 9 protruding from the opening/closing lid 6.

Figure 1B:
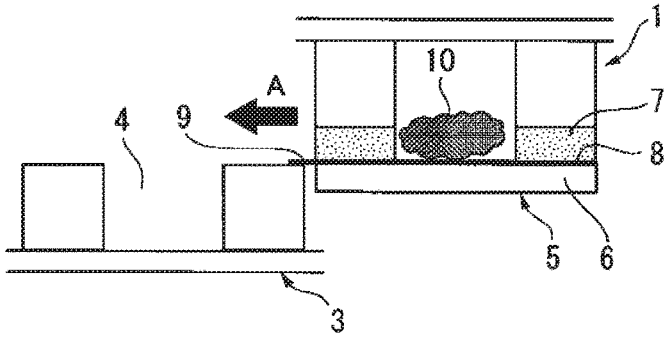
Figure 1C:
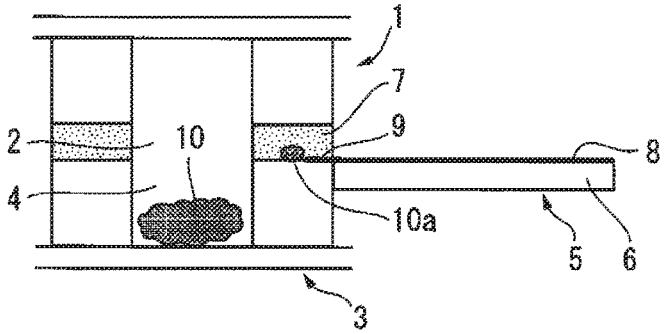

After that, when the powder transport container 1 further moves in the direction of arrow A, as illustrated in FIG. 1B, a container part on the side of the discharging port 2 moves toward the powder receiving container 3 while the opening/closing lid 6 of the opening/closing mechanism 5 is left. When the powder transport container 1 reaches the attachment position, as illustrated in FIG. 1C, the discharging port 2 of the powder transport container 1 communicates with the connection port 4 of the powder receiving container 3, and the opening/closing lid 6 of the opening/closing mechanism 5 is opened. At this time, as illustrated in FIGS. 1B and 1C, the powder 10 in the powder transport container 1 moves toward the powder receiving container 3 along the covering material 8 of the opening/closing lid 6, passes over the protruding piece 9 of the covering material 8 placed between the opening/closing lid 6 and the powder receiving container 3, reaches the edge portion of the connection port 4 in the powder receiving container 3, and then drops from the connection port 4. In this state, since the seal member 7 of the opening/closing mechanism 5 is elastically biased toward the covering material 8 of the opening/closing lid 6, the powder 10 on the covering material 8 having the smooth surface reaches the connection port 4 from the protruding piece 9 of the covering material 8 via the edge portion of the connection port 4 while being scraped by the seal member 7. For this reason, the powder 10 in the powder transport container 1 hardly remains on the opening/closing lid 6, but is carried into the connection port 4 of the powder receiving container 3. A portion of the edge portion of the connection port 4 in the powder receiving container 3 where the protruding piece 9 of the covering material 8 is not disposed has a smoothness lower than that of the surface of the covering material 8, and therefore, a part of the powder 10 (10*a* in FIG. 1C) may remain. However, since the powder part 10*a* remaining in the edge portion of the connection port 4 is elastically biased by the seal member 7 of the opening/closing mechanism 5, it may rarely leak outside.

Figure 1D:
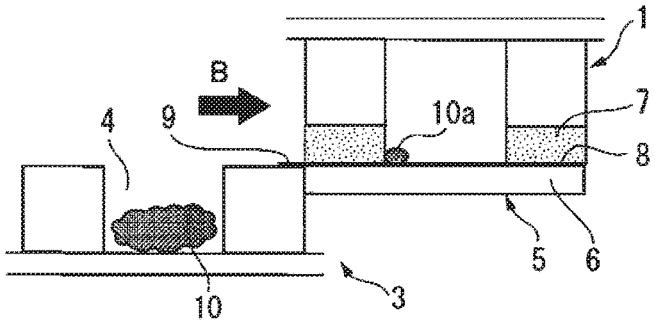

When the powder transport container 1 is detached from the apparatus housing, as illustrated in FIGS. 1C and 1D, it moves in a direction of arrow B. In the opening/closing mechanism 5 of the powder transport container 1, the seal member 7 moves from the edge portion of the connection port 4, passes over the protruding piece 9 of the covering material 8, and moves in contact with the opening/closing lid 6 while being elastically biased toward the opening/closing lid 6. Hence, the powder part 10*a* remaining in the edge portion of the connection port 4 is scraped by the seal member 7, and is returned in the powder transport container 1 at the time when the discharging port 2 on the side of the seal member 7 reaches the position to be closed by the opening/closing lid 6. For this reason, the powder part 10*a* may rarely remain in the edge portion of the connection port 4 in the powder receiving container 3.

An example of the opening/closing mechanism used in the exemplary embodiment will be described.

In this example, the protruding piece 9 of the covering material 8 has a thickness of 300 μm or less or about 300 μm or less. When the protruding piece 9 is such a thin sheet, even when it is disposed in contact with the edge portion of the connection port 4 in the powder receiving container 3, a stepped portion may be hardly formed between the seal member 7 and the edge portion of the connection port 4, and the part of the powder 10 may be hardly caught by the stepped portion. This may maintain high transportability for the powder 10 in the edge portion of the connection port 4.

Further, for example, the protruding piece 9 of the covering material 8 is guided to the edge portion of the connection port 4 while being in contact with an inclined surface (not illustrated) which inclines obliquely downward with increasing distance from the connection port 4. In this example, since the covering material 8 of the opening/closing mechanism 5 is guided to the edge portion of the connection port 4 along the inclined surface of the edge portion of the connection port 4 in the powder receiving container 3, the placement of the protruding piece 9 may be hardly impaired below the discharging port 2.

The present invention will be described in more detail with reference to exemplary embodiments illustrated in the attached drawings.

First Exemplary Embodiment

Figure 2:
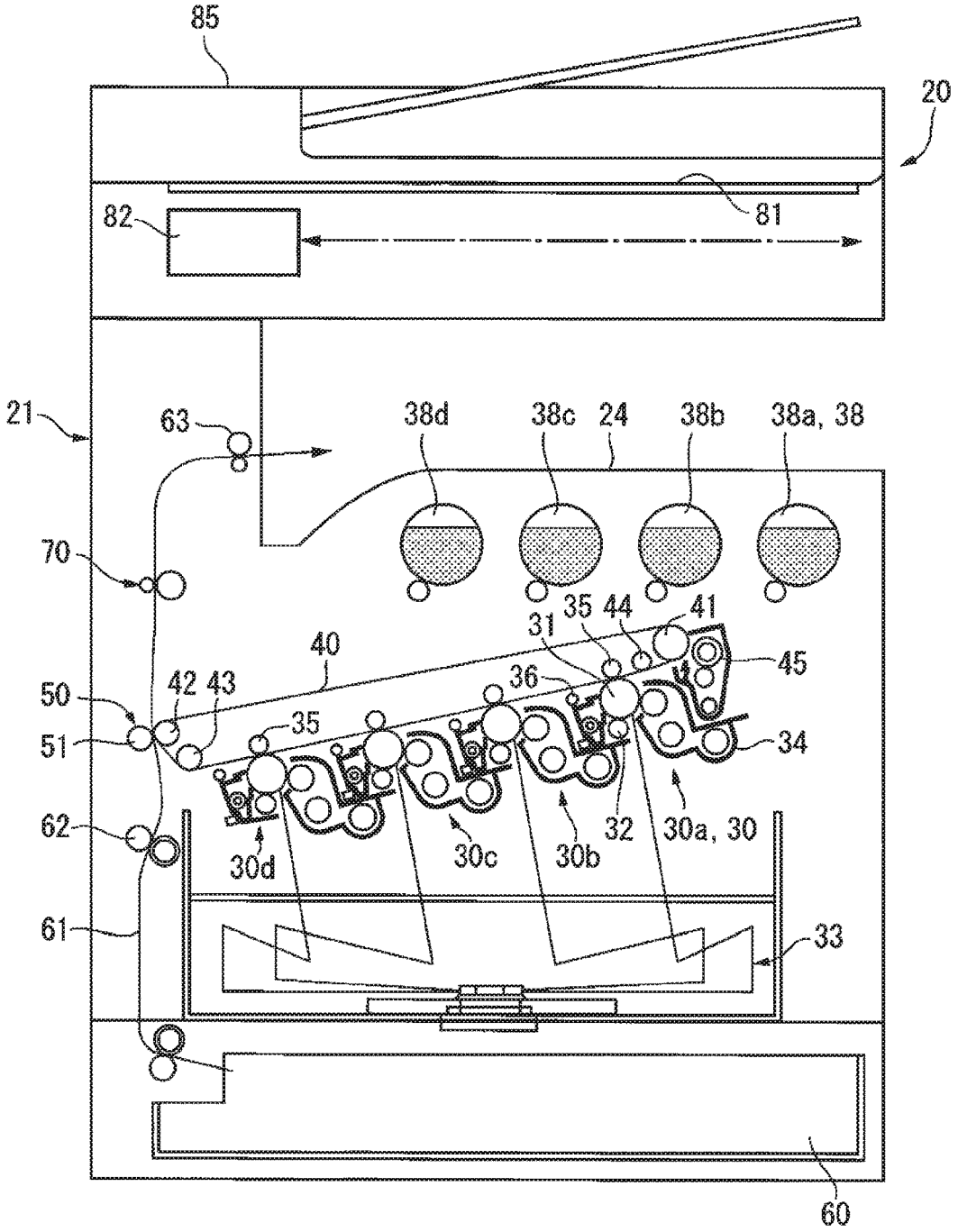
FIG. 2 is an explanatory view illustrating an overall configuration of an image forming apparatus according to a first exemplary embodiment.

FIG. 2 is a perspective view illustrating an overall configuration of an image forming apparatus serving as a powder processing apparatus according to a first exemplary embodiment.

Referring to FIG. 2, an image forming apparatus 20 includes an apparatus housing 21 in which image forming elements are built. The image forming elements include an imaging element that forms an image on a recording material and an image reading element that reads a document image to be formed on the recording material.

In the first exemplary embodiment, the imaging element includes image forming sections 30 (specifically, 30*a* to 30*d*) that form plural color component images by an electrophotographic system, an intermediate transfer body 40 on which the color component images formed by the image forming sections 30 are temporarily transferred before transferred onto a recording material and which is shaped like, for example, a belt, and a collective transfer device 50 that transfers the color component images transferred on the intermediate transfer body 40 onto the recording material. A recording material supplied from a recording-material supply device 60 disposed below the image forming sections 30 is transported by a transport roller 62 in a transport path 61 extending in a substantially vertical direction, and the images on the intermediate transfer body 40 are collectively transferred onto the recording material at a transfer portion in the collective transfer device 50. The images on the recording material are fixed by a fixing device 70 provided on the downstream side of the transport path 61, and the recording material is output into a recording-material receiving unit 24 (to be described later) by an output roller 63 disposed at a position just short of the recording-material receiving unit 24.

Here, each of the image forming sections 30 (30*a* to 30*d*) includes a photoconductor 31 shaped like, for example, a drum, a charging unit 32 that charges the photoconductor 31, an exposure unit 33, such as a laser scanning device, which writes an electrostatic latent image on the charged photoconductor 31 by light, a developing unit 34 that develops the electrostatic latent image formed on the photoconductor 31 with a predetermined color component toner, a transfer unit 35 that transfers a developed image on the photoconductor 31 onto the intermediate transfer body 40, and a cleaning unit 36 that cleans off residual toner on the photoconductor 31.

Toner cartridges 38 (38*a* to 38*d*) each supply a color component toner to the developing unit 34 in the corresponding image forming section 30.

While the exposure unit 33 may be provided in each of the image forming sections 30 (30*a* to 30*d*), it is shared among all the image forming sections 30 in the first exemplary embodiment.

The developing unit 34 uses a two-component developer containing toner and carriers. Alternatively, the developing unit 34 may use a one-component developer that does not contain carriers.

In the first exemplary embodiment, the intermediate transfer body 40 is stretched on plural stretching rollers 41 to 44, and is circularly rotated, for example, by the stretching roller 41 serving as a driving roller. An intermediate cleaning unit 45 is provided on the downstream side of the collective transfer device 50 in a transport direction of the intermediate transfer body 40 to clean off residual toner on the intermediate transfer body 40.

Further, the collective transfer device 50 includes a collective transfer roller 51 that nips the intermediate transfer body 40 between the collective transfer roller 51 and the stretching roller 42 of the intermediate transfer body 40 serving as an opposed roller. A transfer electric field is formed by the application of transfer voltage between the collective transfer roller 51 and the opposed roller formed by the stretching roller 42.

The image reading element includes a document table 81 on which a document to be read is placed. A document on the document table 81 is read by an image reader (scanner) 82, and image signals corresponding to color components are supplied to the exposure unit 33 via an unillustrated image processing unit.

An automatic document supply device 85 automatically supplies documents onto the document table 81.

Developer Collection System

Figure 3:
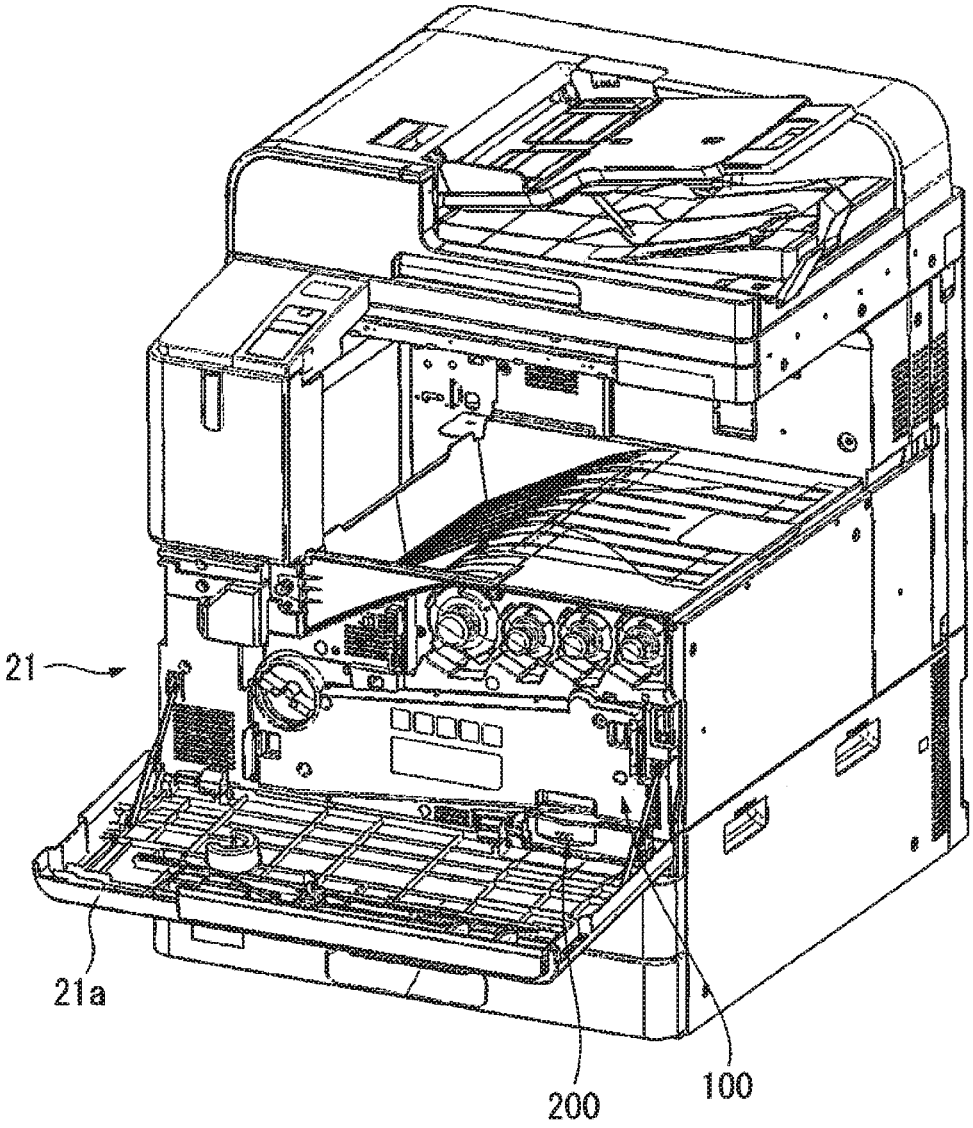
FIG. 3 is a perspective view of the image forming apparatus of the first exemplary embodiment, as viewed from a user operation side (front side)
Figure 4:
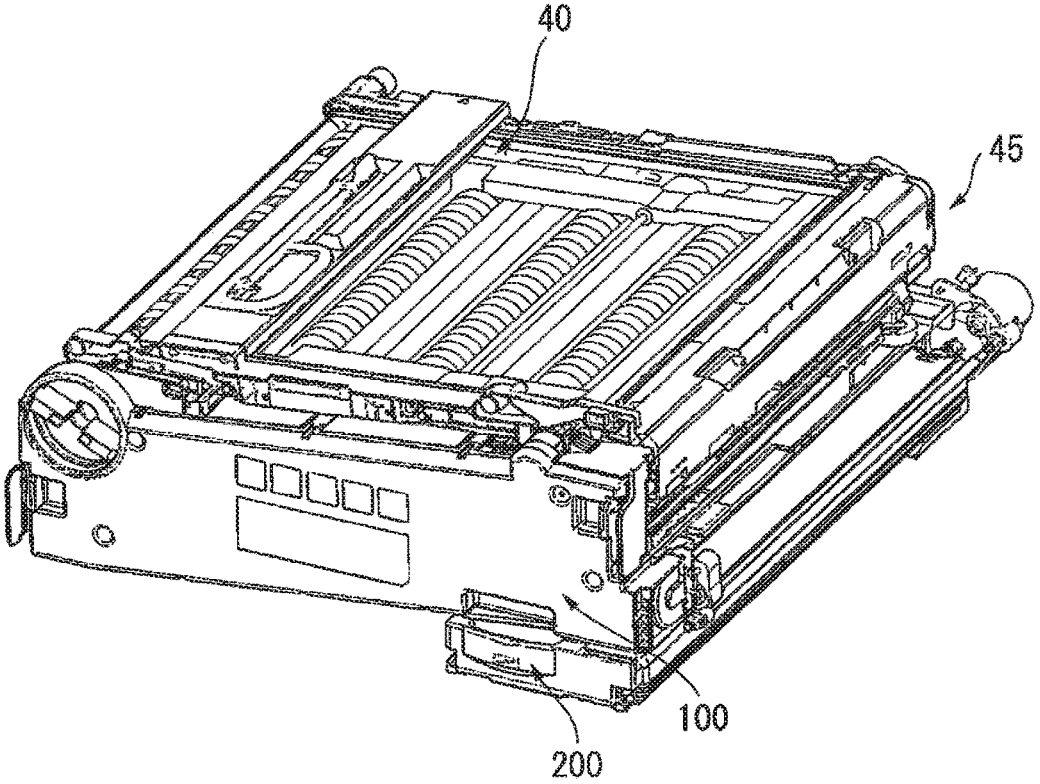
FIG. 4 is an explanatory view illustrating the principal part of a developer collection system illustrated in FIG. 3.
Figure 5:
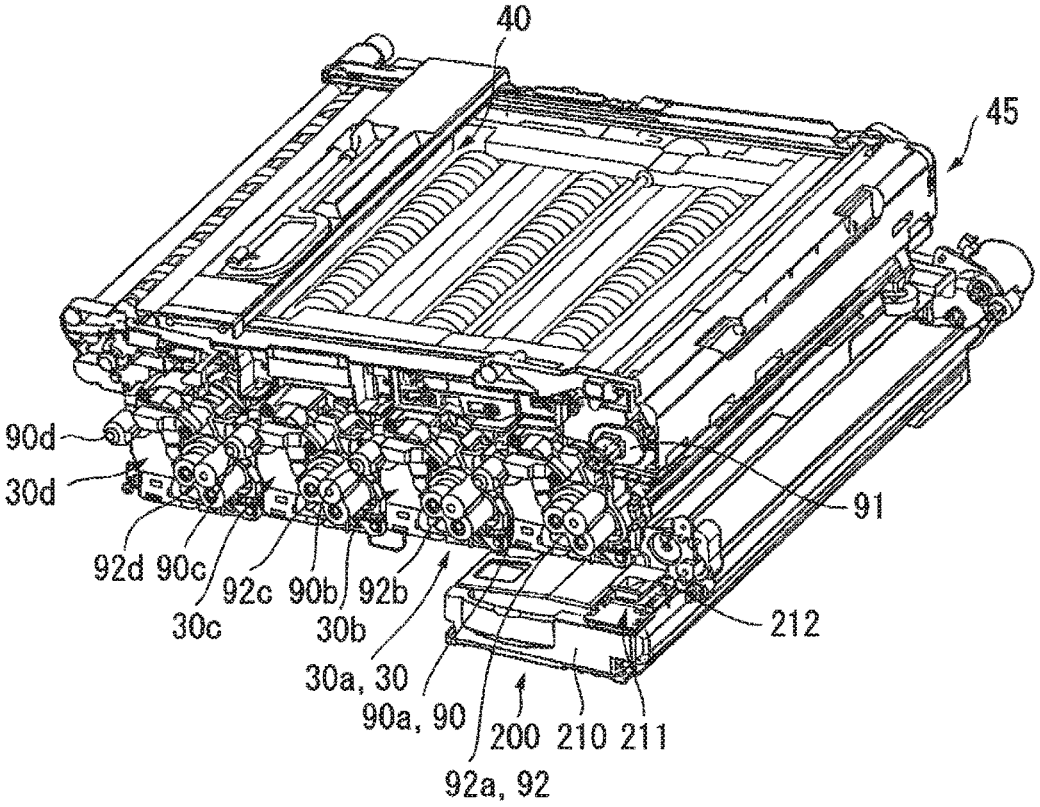
FIG. 5 is an explanatory view illustrating a state in which a developer transport unit in the developer collection system is removed from FIG. 4.

In the first exemplary embodiment, as illustrated in FIGS. 3 to 5, when a front covering 21*a* of the apparatus housing 21 is opened, a toner collection system is built inside the apparatus housing 21 to collect developer serving as powder used in the image forming sections 30 (used waste toner and waste developer in the first exemplary embodiment). The developer collection system of the first exemplary embodiment includes a developer transport unit 100 that receives and transports developer discharged from the image forming sections 30 and the intermediate transfer body 40, and a developer collection box 200 that collects the developer transported by the developer transport unit 100.

Developer Transport Unit

In the first exemplary embodiment, for example, the developer transport unit 100 is supported pivotally on an unillustrated hinge portion on the front side of the apparatus housing 21 to be attached and detached along a substantially linear track from the front side toward the depth side, and is attached at a predetermined set position. In the first exemplary embodiment, developer to be carried into the developer transport unit 100 is discharged from the following three systems:

(1) The cleaning unit 36 in each of the image forming sections 30 (30*a* to 30*d*) cleans off developer (waste toner) remaining on the photoconductor 31. The cleaned waste toner is discharged from one end of a cleaning container by a transport member inside the cleaning unit 36, and is carried into the developer transport unit 100 via a waste-toner discharging part 90 (specifically discharging parts 90*a* to 90*d*), as illustrated in FIGS. 5 to 8.

(2) The intermediate cleaning unit 45 cleans off developer (waste toner) remaining on the intermediate transfer body 40. The cleaned waste toner is discharged from one end of a cleaning container by a transport member inside the intermediate cleaning unit 45, and is carried into the developer transport unit 100 via a waste-toner discharging part 91, as illustrated in FIGS. 5 to 8.

Figure 6:
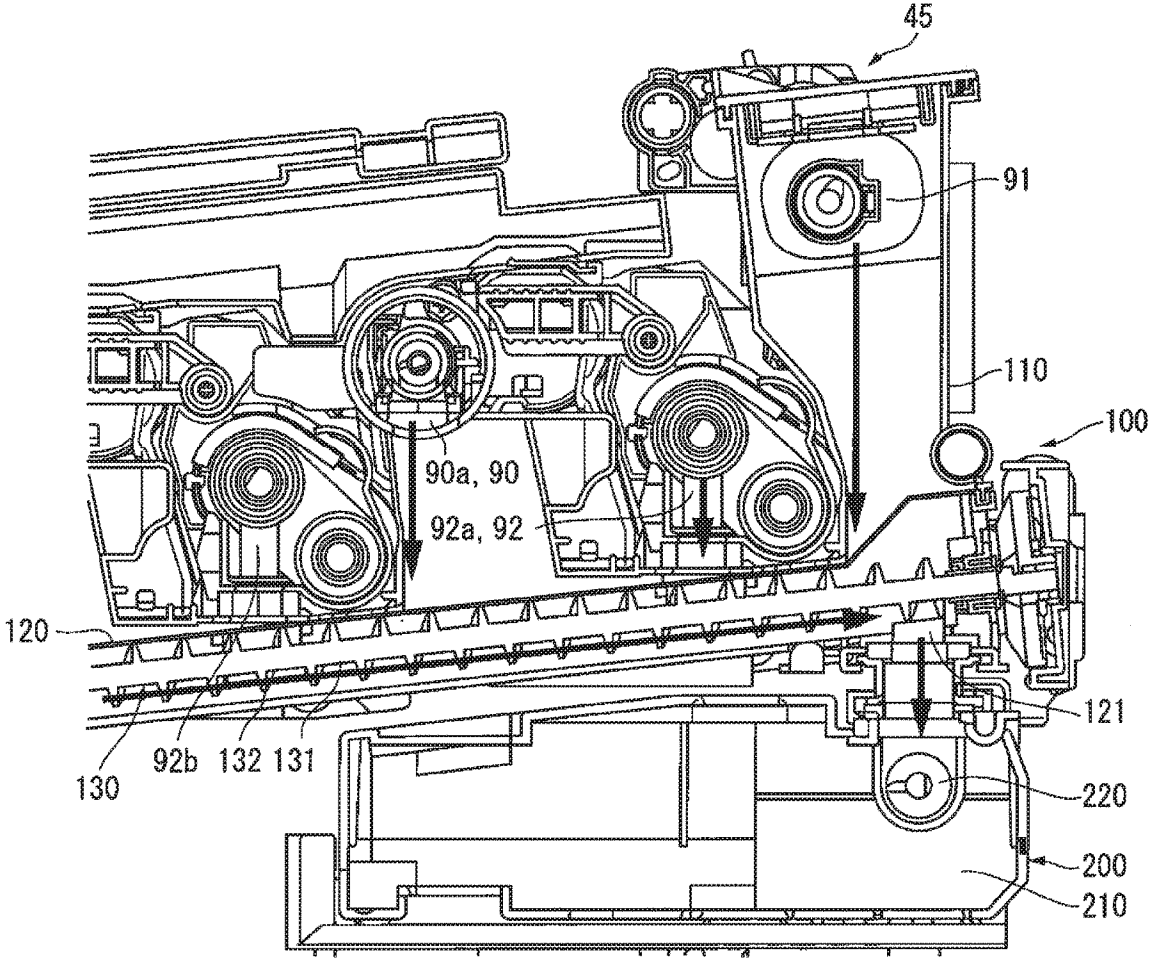
FIG. 6 is an explanatory view illustrating the flow of developer in the developer collection system of FIG. 3.
Figure 8:
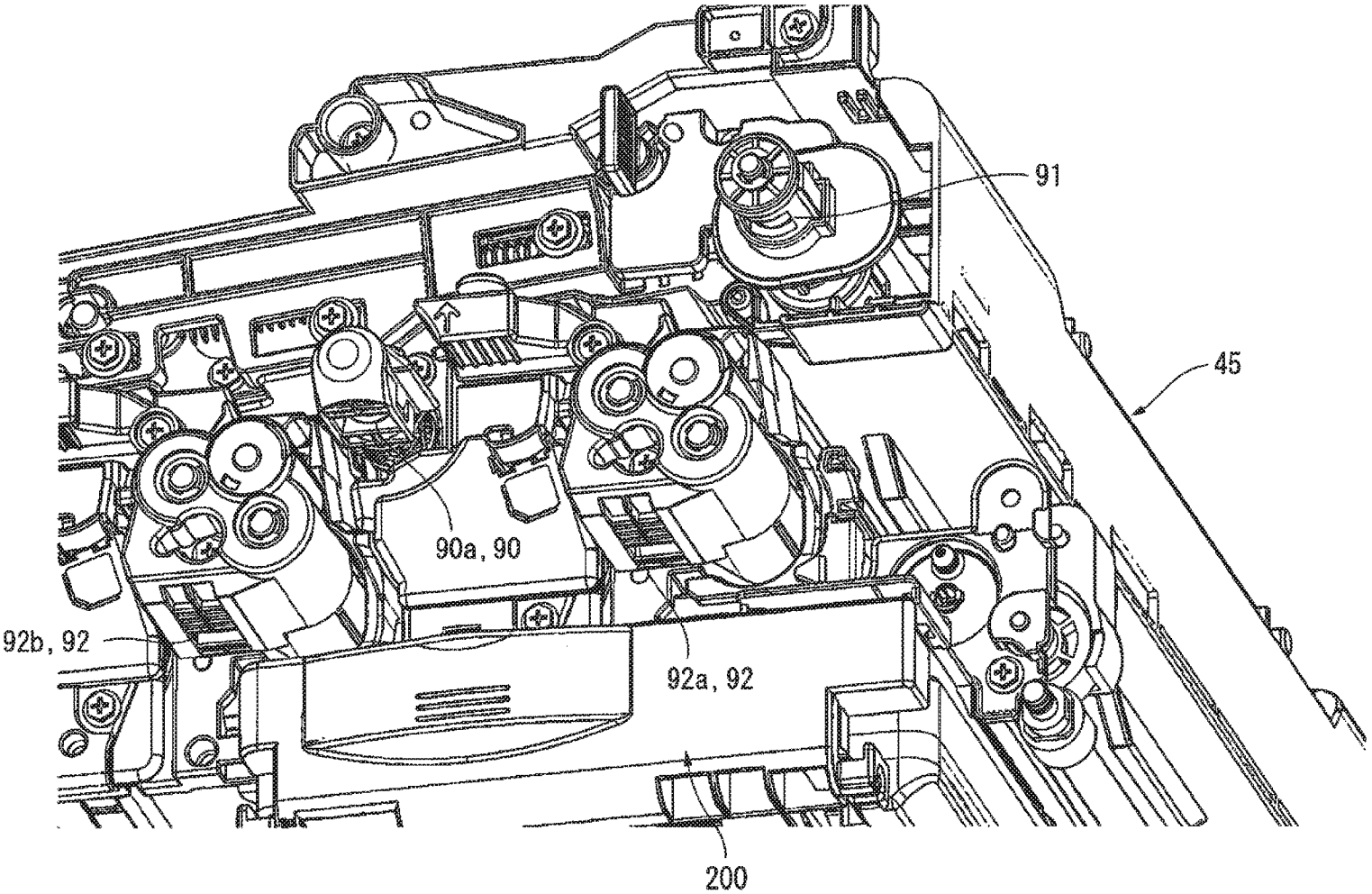
FIG. 8 is an explanatory view illustrating an example of a structure for introducing developer to the developer transport unit in the developer collection system of FIG. 3.
Figure 9:
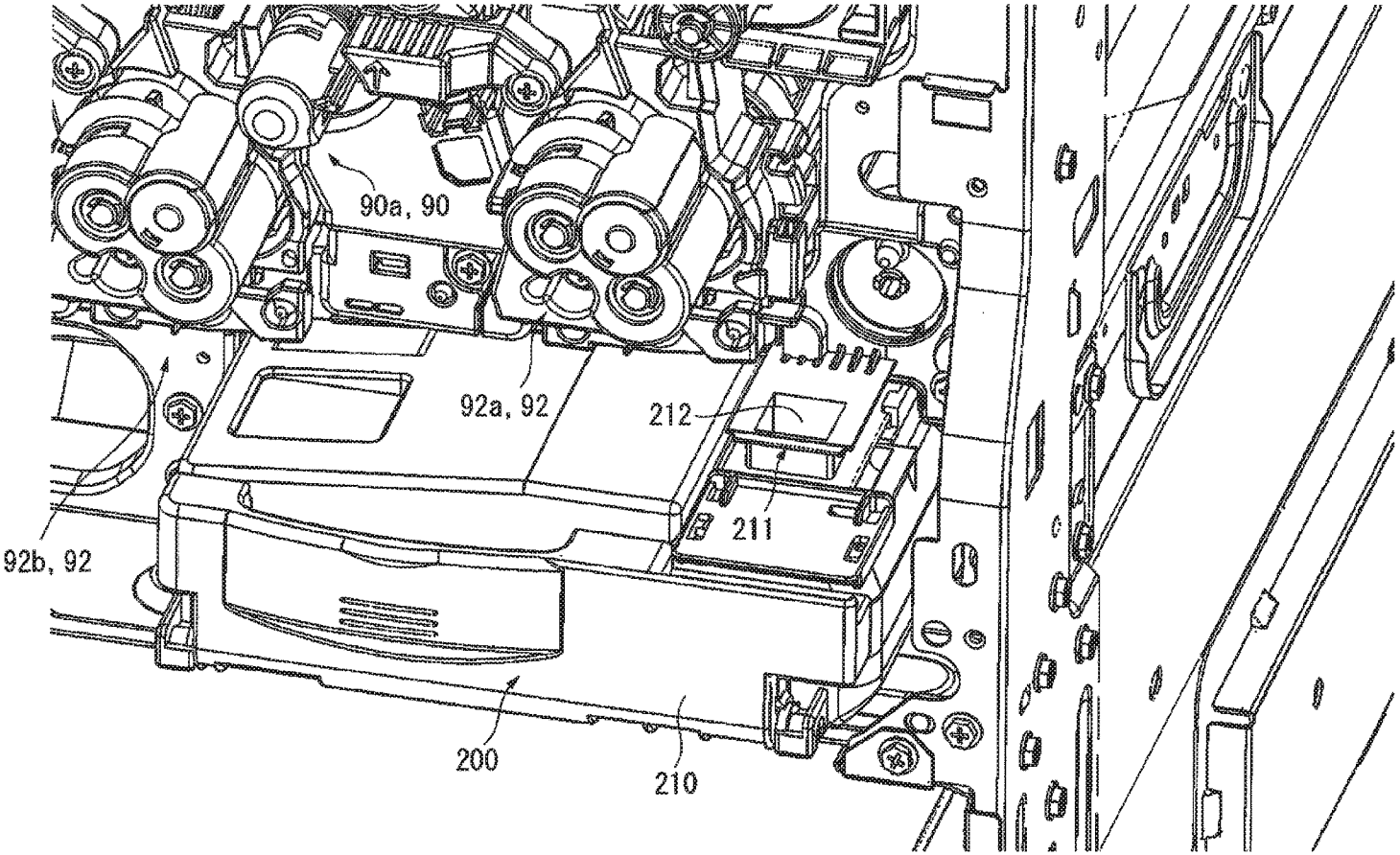
FIG. 9 is an explanatory view illustrating a connection structure to a developer collection box in the developer collection system of FIG. 3.

(3) In a developing container of the developing unit 34 in each of the image forming sections 30 (30*a* to 30*d*), a developing roller is disposed, and, for example, plural agitating transport members are disposed to charge the developer while agitating and mixing the developer. Since the carriers in the developer are not consumed, but remain, if they become old, charging characteristics of the developer may be impaired. For this reason, in the first exemplary embodiment, old developer (waste developer) is periodically disposed of from the developing container to the outside, and is then carried into the developer transport unit 100 via a developer discharging part 92 (specifically developer discharging parts 92*a* to 92*d*), as illustrated in FIGS. 5, 6, and 8.

Structure of Developer Transport Unit

In the first exemplary embodiment, the developer transport unit 100 includes a transport container 110 nearly shaped a hollow rectangular parallelepiped, as illustrated in FIGS. 3 to 8. Inside the transport container 110, a transport duct 120 is provided to transport received developer. Inside the transport duct 120, for example, a transport member 130 formed by providing a spiral blade 132 integrally around a rotation shaft 131 is provided. The transport member 130 transports the received developer into the developer collection box 200.

Receiving Port and Discharging Port

Figure 7:
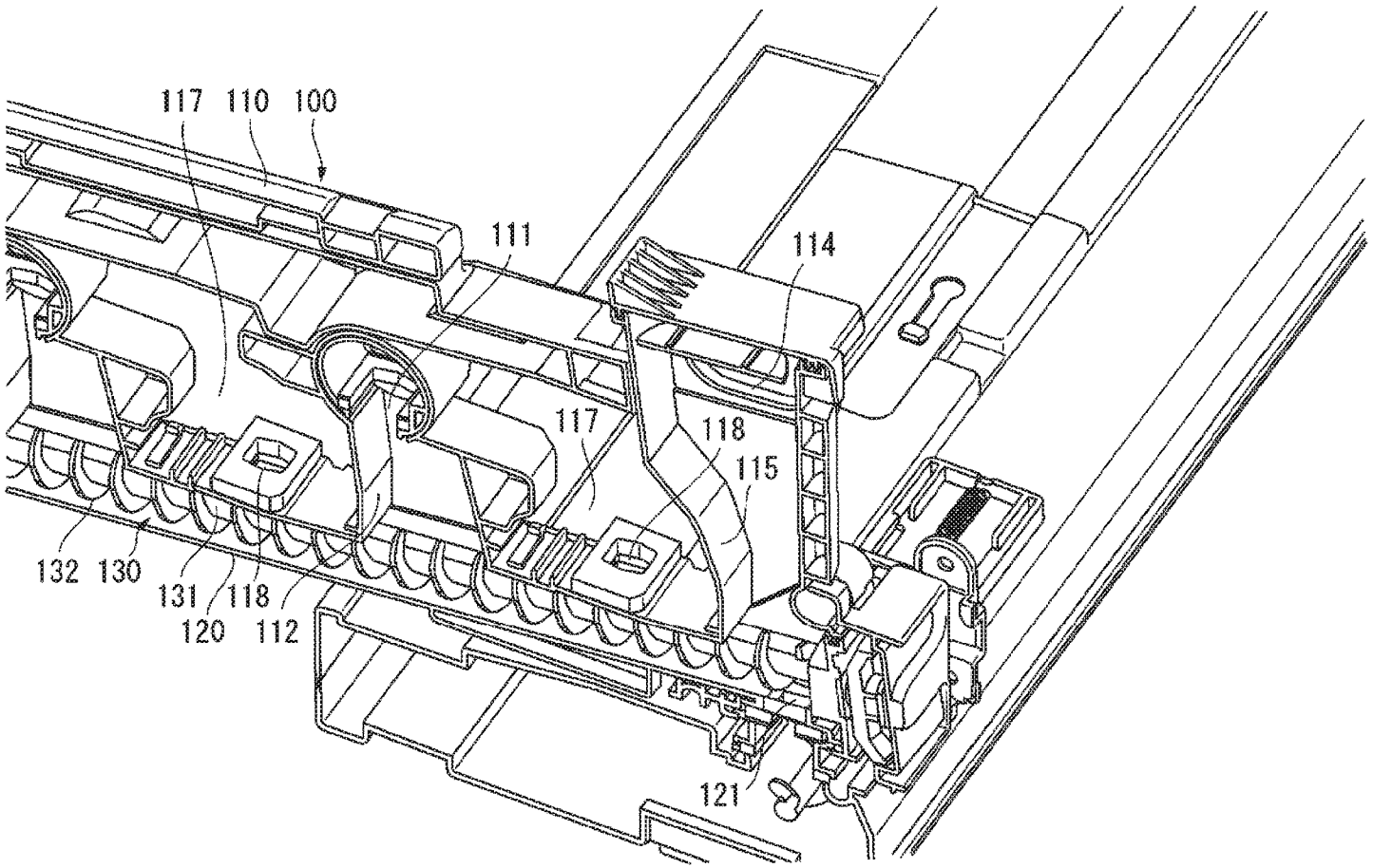
FIG. 7 is an explanatory view illustrating an internal structure of the developer transport unit in the developer collection system of FIG. 3.

In the first exemplary embodiment, as illustrated in FIGS. 6 and 7, the transport container 110 includes a receiving port 111 to which the waste-toner discharging part 90 in the cleaning unit 36 in each of the image forming sections 30 is to be connected, and a communication duct 112 provided between the receiving port 111 and the transport duct 120. The transport container 110 also includes a receiving port 114 to which the waste-toner discharging part 91 of the intermediate cleaning unit 45 is to be connected, and a communication duct 115 provided between the receiving port 114 and the transport duct 120. The transport container 110 further includes a receiving port 117 to which the developer discharging part 92 of the developing unit 34 in each of the image forming sections 30 is to be connected, and the transport duct 120 corresponding to the receiving port 117 has a communication port 118 communicating with a discharging port of the developer discharging part 92.

In the first exemplary embodiment, a discharging port 121 opening downward is provided in a portion of the transport duct 120 on the downstream side in the developer transport direction. A shutter mechanism 140 (see FIGS. 10 and 11) is provided to open and close the discharging port 121. The structure of the shutter mechanism 140 will be described later.

In this way, in the developer transport unit 100 of the first exemplary embodiment, used developer from the image forming sections 30 and the intermediate transfer body 40 is carried into the transport container 110, and then drops into the transport duct 120. After that, the developer is transported by the transport member 130 in the transport duct 120, and is collected from the discharging port 121 into the developer collection box 200.

Developer Collection Box

In the first exemplary embodiment, as illustrated in FIGS. 3 to 5 and 9, the developer collection box 200 is disposed below the discharging port 121 of the transport container 110 in the developer transport unit 100, and includes a collection container 210 nearly shaped like a hollow rectangular parallelepiped and extending in a direction substantially orthogonal to the transport container 110. The collection container 210 has a connection duct 211 to be connected to the discharging port 121 of the developer transport unit 100 when the developer transport unit 100 is attached at the set position. The collection container 210 is disposed so that a connection port 212 of the connection duct 211 communicates with the discharging port 121. Further, in the first exemplary embodiment, a transport member 220 is provided inside the collection container 210 to agitate and transport the developer in the longitudinal direction of the collection container 210. While the transport member 220 of the first exemplary embodiment is formed, for example, by providing a spiral blade 222 (see FIG. 13) integrally around a rotation shaft 221, any functional member for agitating and transporting the developer may be selected appropriately.

Shutter Mechanism

Next, a description will be given of the shutter mechanism 140 that opens and closes the discharging port 121 of the developer transport unit 100.

Figure 10:
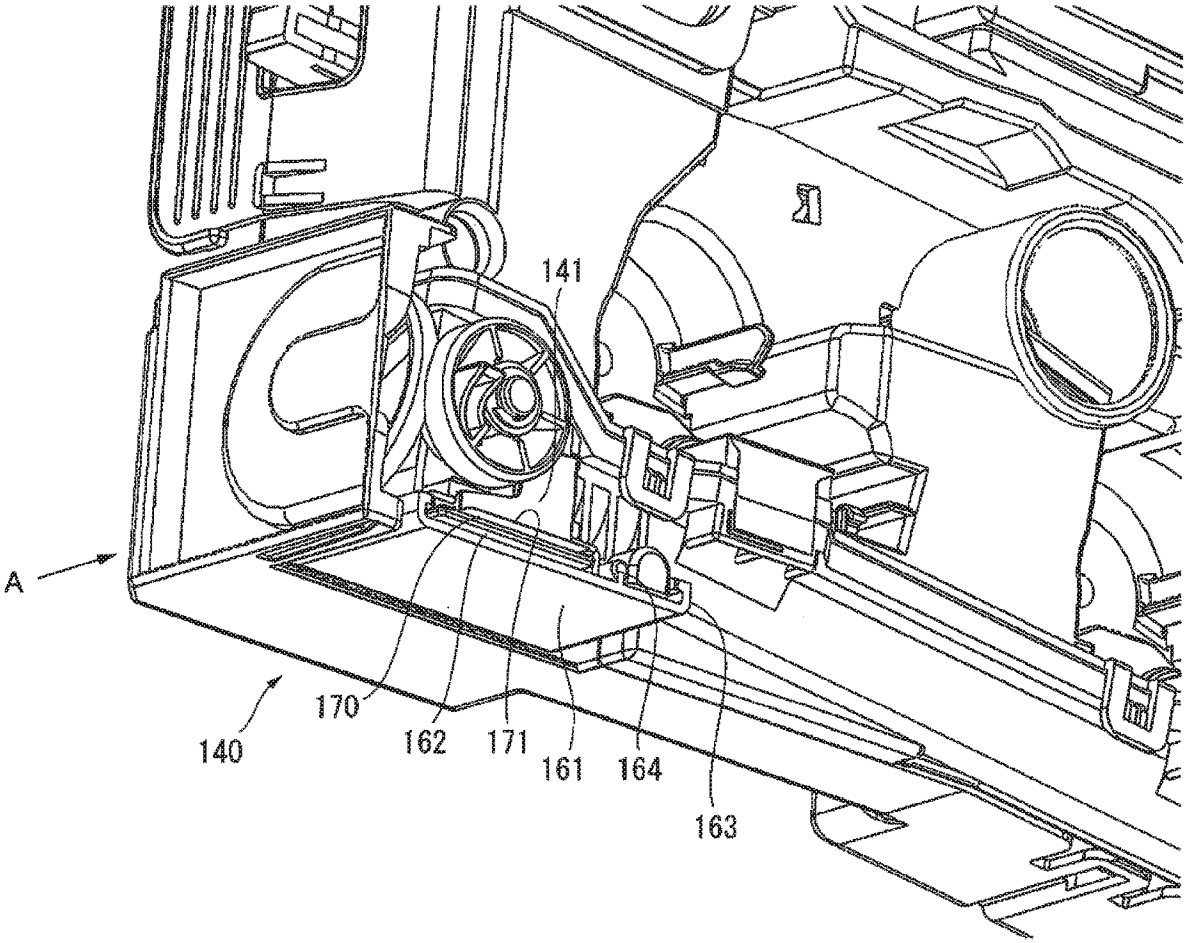
FIG. 10 is an explanatory view illustrating a shutter mechanism provided at a discharging port of the developer transport unit.
Figure 11:
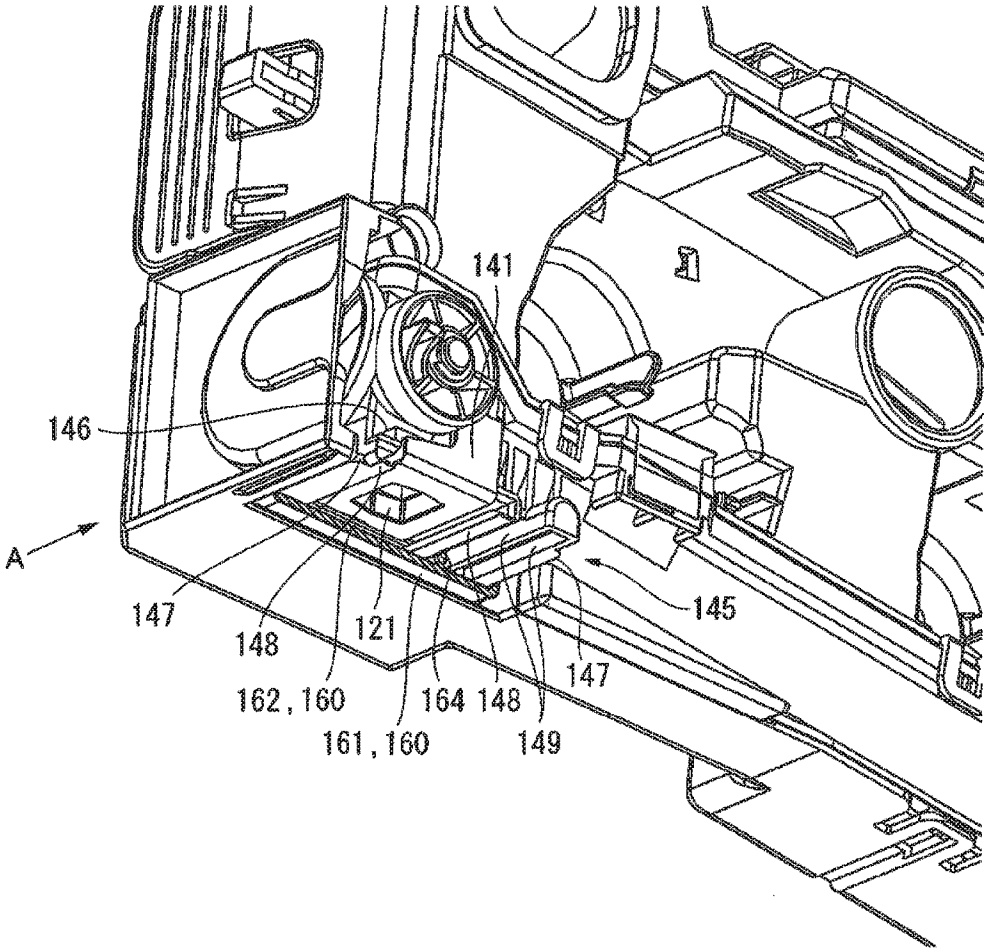
FIG. 11 is a partly cutaway explanatory view of the shutter mechanism of FIG. 10.
Figure 13:
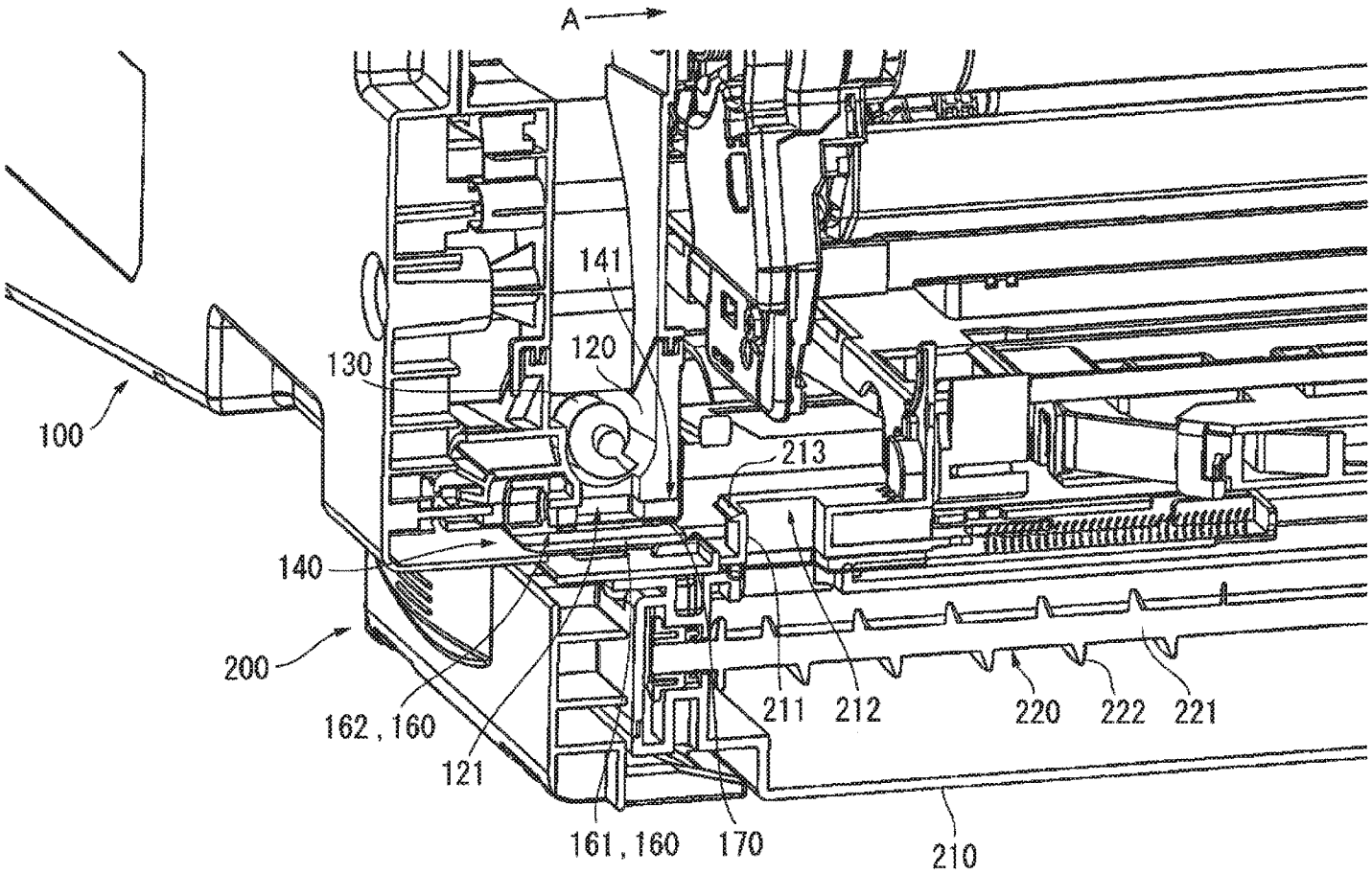
FIG. 13 is an explanatory view illustrating an operation process (1) in which the shutter mechanism moves from a closing position to an open position when the developer transport unit is attached to an apparatus housing in the first exemplary embodiment.

In the first exemplary embodiment, as illustrated in FIGS. 10 and 13, a part of the shutter mechanism 140 that defines the discharging port 121 of the transport duct 120 is formed by an elastically deformable seal member 141. Around the seal member 141 in the transport duct 120, a holding frame 145 is provided to hold an opening/closing lid 160 openably and closably.

In the first exemplary embodiment, the seal member 141 includes an elastic body 142 integrally formed of an elastic sponge material, such as urethane sponge obtained by foaming polyurethane, in a predetermined shape. A surface of the elastic body 142 is covered with a front layer 143 formed of, for example, felt.

Figure 12A:
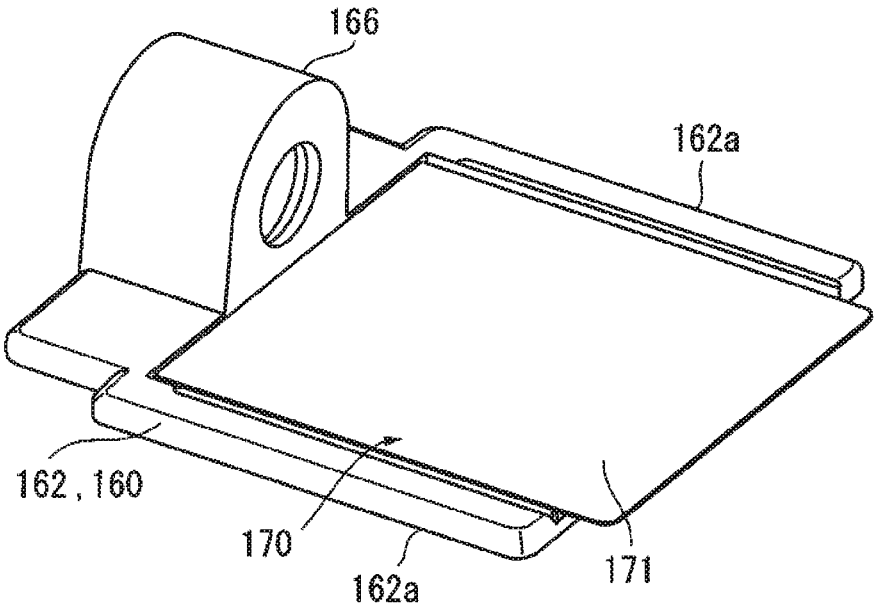
FIG. 12A is an explanatory view illustrating an exemplary structure around an opening/closing lid in the shutter mechanism of FIG. 10.
Figure 12B:
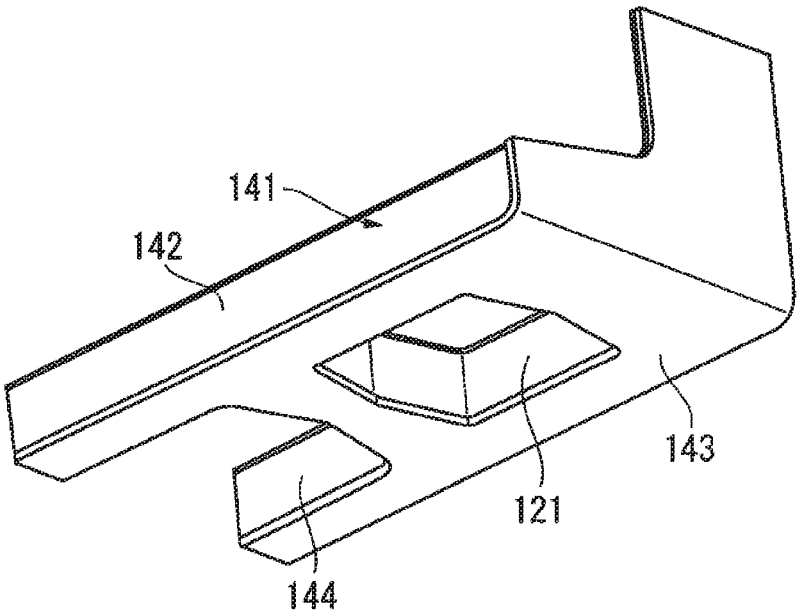
FIG. 12B is an explanatory view illustrating an exemplary structure around a discharging port in the shutter mechanism.

In the first exemplary embodiment, as illustrated in FIG. 12B, the seal member 141 has a substantially U-shaped cutout 144 at a position adjacent to an area where the discharging port 121 is provided.

The holding frame 145 includes a frame body 146 that clamps the seal member 141 along a direction (direction of arrow A in FIG. 10) intersecting the longitudinal direction of the transport duct 120 at right angles. A pair of first guide rails 147 are provided at opposite side edges of the frame body 146 apart from the seal member 141, and second guide rails 148 having an L-shaped hook-like cross section are provided at positions of the frame body 146 close to the seal member 141. Further, the frame body 146 includes one or plural guide grooves 149 (two in the first exemplary embodiment) parallel to the guide rails 147 and 148.

In the first exemplary embodiment, the opening/closing lid 160 has a two-part structure in which upper and lower parts are placed one on another. A lower opening/closing lid 161 located on the lower side has a substantially rectangular plate. On opposite sides of the plate in a direction intersecting the opening/closing direction, holding arms 163 are provided to be held in the first guide rails 147. Further, at the positions corresponding to the guide grooves 149 provided in the frame body 146, guided pins 164 are provided to be slidably guided by the guide grooves 149.

On the other hand, an upper opening/closing lid 162 located on the upper side has a substantially rectangular flat plate that is smaller in size than the lower opening/closing lid 161. Opposite side edges 162*a* of the flat plate in the direction intersecting the opening/closing direction are held in the second guide rails 148 of the holding frame 145.

In the first exemplary embodiment, as illustrated in FIG. 12A, the upper opening/closing lid 162 is structured so that its surface opposed to the discharging port 121 and the surrounding area in the seal member 141 is covered with a covering sheet 170. The covering sheet 170 may be appropriately selected as long as it has a surface smoother than the surface of the seal member 141 (front layer 143 in the first exemplary embodiment), and, for example, a resin sheet, such as a Mylar (trademark), is used. Here, the thickness of the covering sheet 170 is selected according to the number of attachment and detachment operations of the developer transport unit 100 and the strength of the covering sheet 170. The thickness is preferably 300 μm or less, more preferably 250 μm or less.

As illustrated in FIG. 12A, a part 166 is provided in an area of the upper opening/closing lid 162 that is not covered with the covering sheet 170, is fitted in the cutout 144 of the seal member 141, and functions as a receiving portion for an unillustrated bias member (for example, compression coil spring).

Further, in the first exemplary embodiment, as illustrated in FIG. 12A, the covering sheet 170 has a protruding piece 171 that protrudes from one end of the upper opening/closing lid 162 in the opening/closing direction toward the connection port 212 of the developer collection box 200.

The first exemplary embodiment adopts the positional relationship such that the opening/closing lid 160 (lower opening/closing lid 161, upper opening/closing lid 162) collides with an edge portion 211*a* of the connection duct 211 in the developer collection box 200 just before the developer transport unit 100 is attached at the set position. In the state in which the opening/closing lid 160 abuts on the edge portion 211*a* of the connection duct 211, the protruding piece 171 of the covering sheet 170 is disposed in contact with an edge portion of the connection port 212 of the connection duct 211. At this time, the protrusion dimension of the protruding piece 171 of the covering sheet 170 is selected so that the distal end of the protruding piece 171 does not enter an opening area of the connection port 212.

Further, while the edge portion of the connection port 212 of the connection duct 211 in the developer collection box 200 may be shaped like a flat surface in the first exemplary embodiment, for example, as illustrated in FIG. 13, the edge portion 211*a* of the connection duct 211 has an inclined surface 213 that inclines obliquely downward with increasing distance from the connection port 212 so that the protruding piece 171 of the covering sheet 170 is reliably disposed in contact with the edge portion of the connection port 212 of the connection duct 211.

In the first exemplary embodiment, the opening/closing lid 160 (lower opening/closing lid 161, upper opening/closing lid 162) is always biased toward a closing position to close the discharging port 121 by an unillustrated biasing member (for example, a compression coil spring).

While the opening/closing lid 160 has a two-part structure in the first exemplary embodiment, the structure is not limited thereto. For example, only the upper opening/closing lid 162 may be provided without forming the lower opening/ closing lid 161. However, in the case in which the opening/closing lid 160 has the two-part structure and the upper opening/closing lid 162 is covered with the lower opening/closing lid 161, as in the first exemplary embodiment, when the developer transport unit 100 is attached and detached, even if developer adhering to the upper opening/closing lid 162 falls from the surroundings, it is received by the lower opening/closing lid 161. Hence, scattering of the developer from the discharging port may be more effectively suppressed. Further, the lower opening/closing lid 161 is structured to cover the toner soiled portion (upper opening/closing lid 162), and this may reduce the operator's risk of touching the toner soiled portion when attaching and detaching the developer transport unit 100.

Next, a description will be given of the behavior of the shutter mechanism 140 when the developer transport unit 100 is attached and detached in the first exemplary embodiment.

Behavior of Shutter Mechanism

When Developer Transport Unit is Attached

When the developer transport unit 100 is attached at the set position in the apparatus housing 21 (corresponding to a position of FIG. 17 in the first exemplary embodiment), as illustrated in FIG. 13, it is pushed from the front side of the apparatus housing 21 in the direction of arrow A along a predetermined substantially linear track.

Then, as illustrated in FIGS. 14 to 17, the shutter mechanism 140 moves along with the movement of the developer transport unit 100, and gradually changes from a closed state to an open state. When the developer transport unit 100 reaches the set position, the shutter mechanism 140 is put in the open state, and the discharging port 121 of the developer transport unit 100 communicates with the connection port 212 of the developer collection box 200.

The opening/closing lid 160 having the two-part structure (lower opening/closing lid 161, upper opening/closing lid 162) moves integrally in the shutter mechanism 140 of the first exemplary embodiment. To make it easy to understand the behavior of the shutter mechanism 140, the behavior of the upper opening/closing lid 162 will be described as the opening/closing lid 160 with reference to a model diagram (FIG. 18A) in which the shutter mechanism 140 is simplified.

Figure 18A:
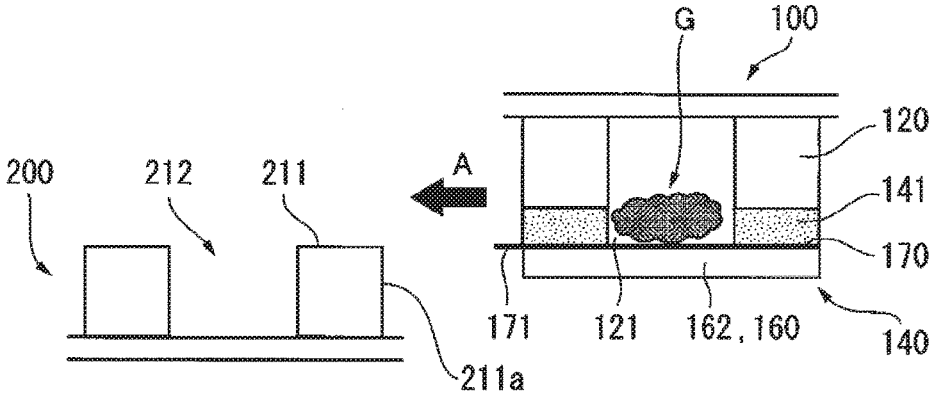
FIG. 18A is an explanatory view schematically illustrating the principal part of the shutter mechanism used in the first exemplary embodiment.

The model diagram of FIG. 18A illustrates the developer transport unit 100 and the developer collection box 200. In the shutter mechanism 140, the discharging port 121 defined by the seal member 141 is opened and closed by the opening/closing lid 160 (only the upper opening/closing lid 162 is illustrated herein). The side of the opening/closing lid 160 close to the seal member 141 is covered with the covering sheet 170, and the covering sheet 170 has the protruding piece 171.

Figure 14:
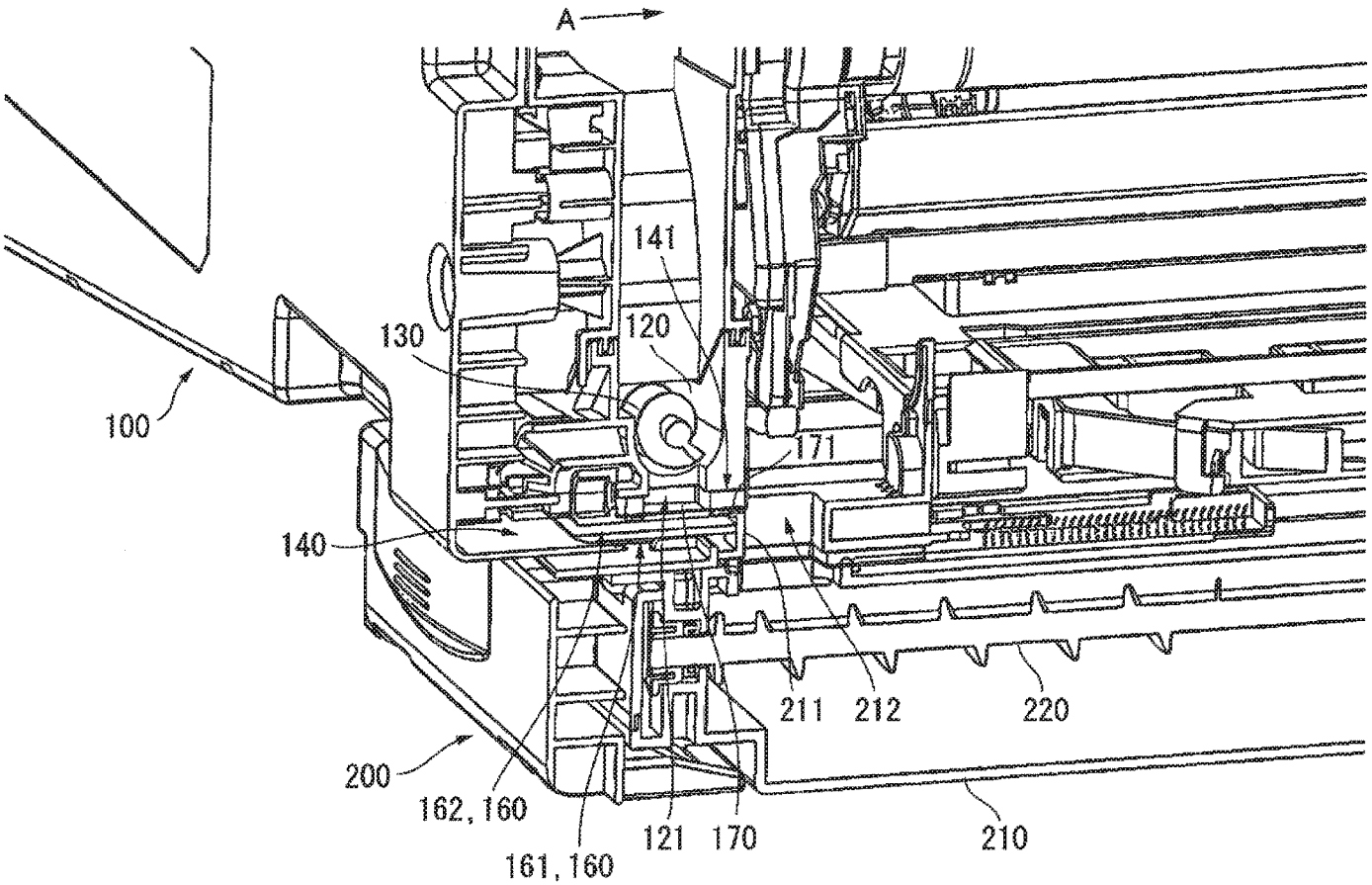
FIG. 14 illustrates an operation process (2) of the shutter mechanism.
Figure 19A:
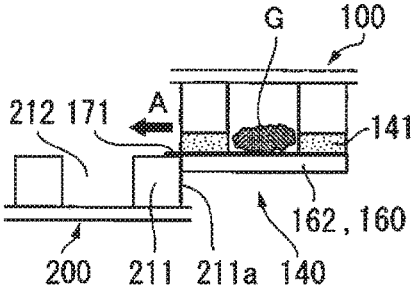
FIGS. 19A to 19D are explanatory views illustrating the behavior of the shutter mechanism from the closing position to the open position when the developer transport unit is attached in the first exemplary embodiment.

When the developer transport unit 100 is moved in the direction of arrow A toward the set position in the apparatus housing 21, as illustrated in FIGS. 14 and 19A, the opening/closing lid 160 (upper opening/closing lid 162) of the shutter mechanism 140 collides with the edge portion 211*a* of the connection duct 211 in the developer collection box 200. In this state, the opening/closing lid 160 (upper opening/closing lid 162) is stopped by the connection duct 211. On the other hand, the opening/closing lid 160 (upper opening/closing lid 162) is provided with the covering sheet 170, and the protruding piece 171 of the covering sheet 170 is disposed in contact with the edge portion of the connection port 212 of the connection duct 211.

Figure 18B:
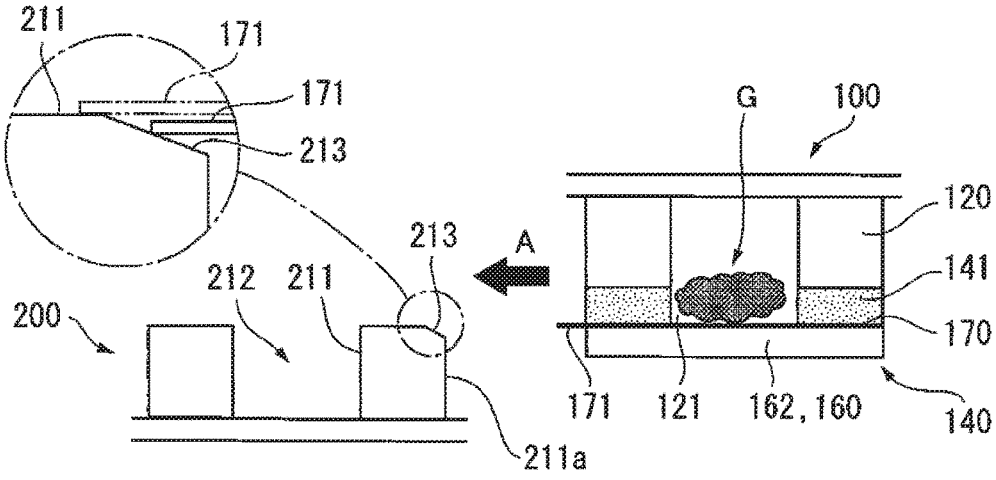
FIG. 18B is an explanatory view illustrating a modification of the shutter mechanism used in the first exemplary embodiment.

In particular, in the first exemplary embodiment, as illustrated in FIG. 18B, the edge portion 211*a* of the connection duct 211 has the inclined surface 213 that inclines obliquely downward with increasing distance from the connection port 212. Hence, even when the distal end of the protruding piece 171 of the covering sheet 170 reaches the edge portion 211*a* of the connection duct 211 in a slightly declined state, it is guided along the inclined surface 213 of the connection duct 211 toward the edge portion of the connection port 212. Thus, the protruding piece 171 of the covering sheet 170 may be stably disposed in contact with the edge portion of the connection port 212 of the connection duct 211.

Figure 15:
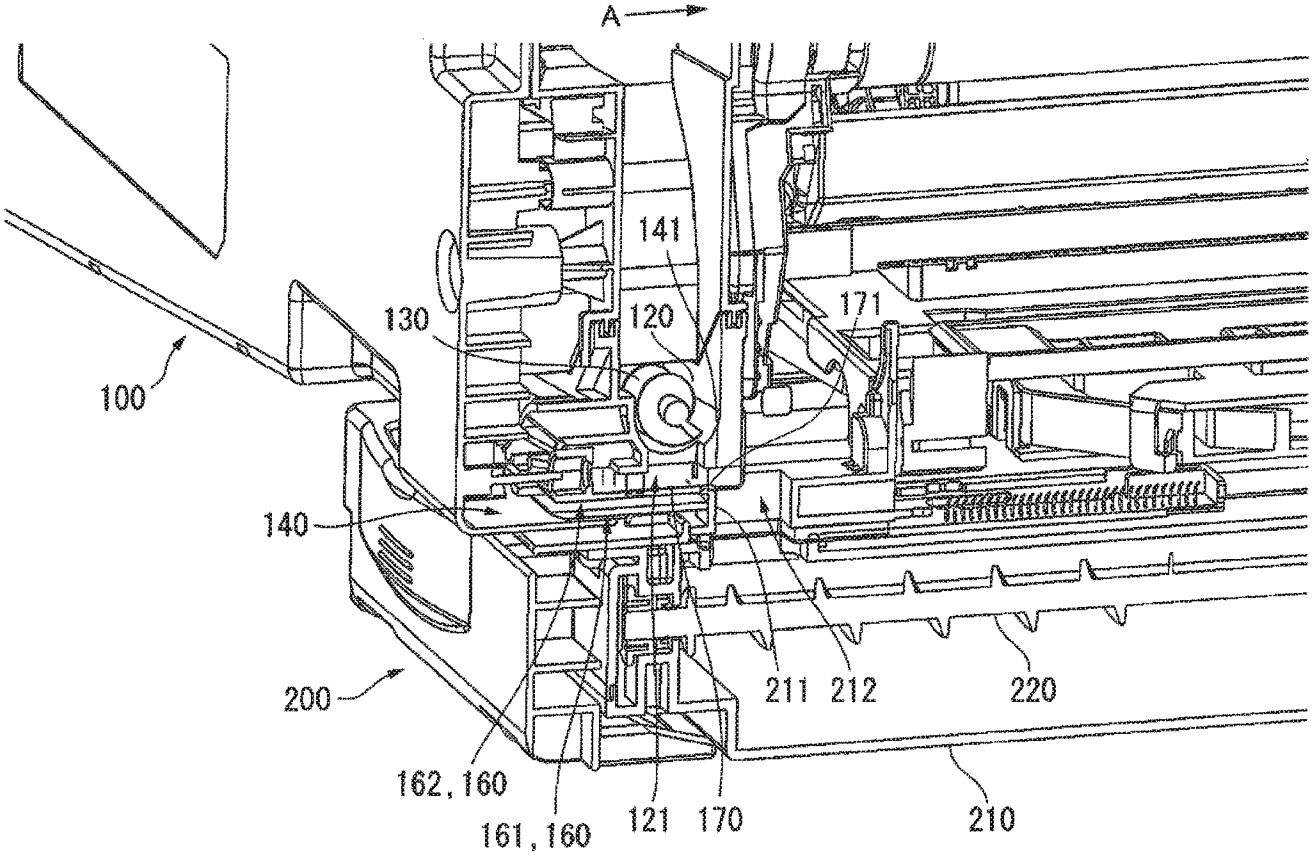
FIG. 15 illustrates an operation process (3) of the shutter mechanism.
Figure 19E:
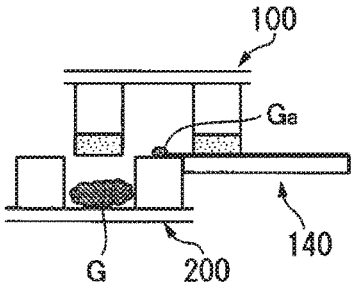
FIGS. 19E to 19H are explanatory views illustrating the behavior of the shutter mechanism from the open position to the closing position when the developer transport unit is detached.
Figure 19B:
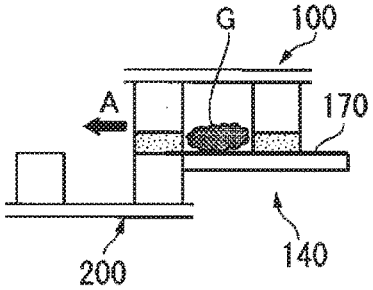

When the developer transport unit 100 is further moved in the direction of arrow A after that, as illustrated in FIGS. 15 and 19B, the opening/closing lid 160 (upper opening/closing lid 162) of the shutter mechanism 140 is stopped by the edge portion 211*a* of the connection duct 211. Hence, a container part of the shutter mechanism 140 moves toward the developer collection box 200. During this movement, developer G accumulating on the covering sheet 170 of the opening/closing lid 160 (upper opening/closing lid 162) is scraped by the seal member 141, and moves along the smooth surface of the covering sheet 170.

Figure 16:
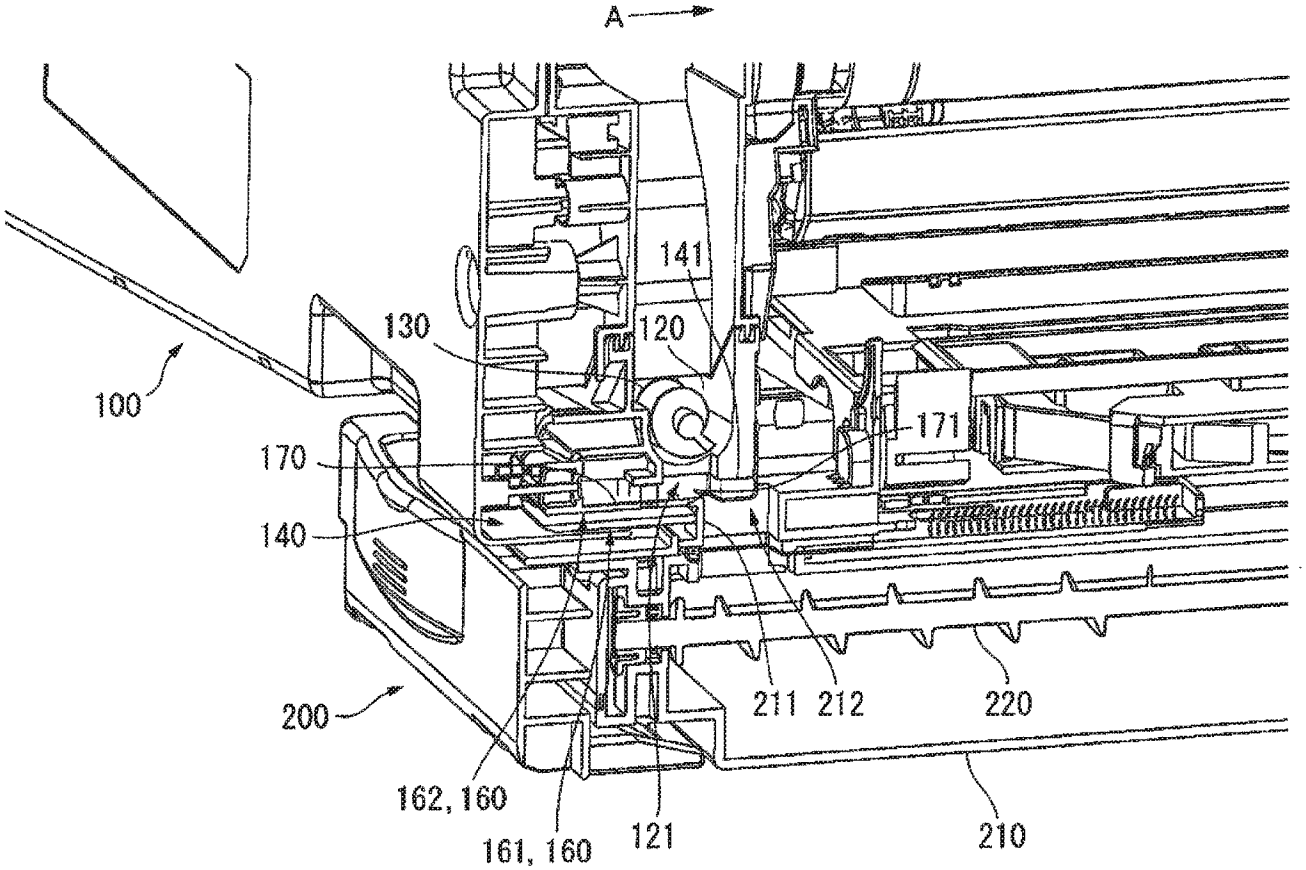
FIG. 16 illustrates an operation process (4) of the shutter mechanism.
Figure 19F:
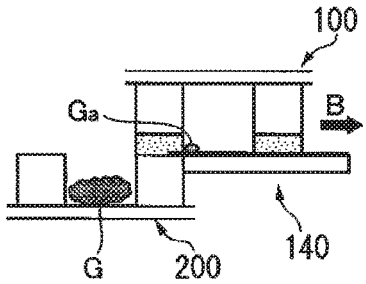
Figure 19C:
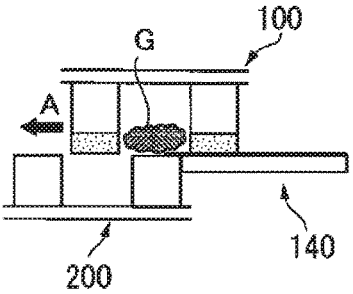

When the developer transport unit 100 is further moved in the direction of arrow A, as illustrated in FIGS. 16 and 19C, the container part of the shutter mechanism 140 moves toward the developer collection box 200. During this movement, the seal member 141 moves across the connection port 212 of the connection duct 211 in the developer collection box 200, and the discharging port 121 of the developer transport unit 100 moves to the position facing the connection port 212 of the connection duct 211. In this state, the developer G in the developer transport unit 100 moves on the covering sheet 170 of the opening/closing lid 160 (upper opening/closing lid 162), reaches the edge portion of the connection port 212 of the connection duct 211 via the protruding piece 171 of the covering sheet 170, and drops into the connection port 212 that starts communicating with the discharging port 121. At this time, even when there is a minute gap in the contact portion between the opening/closing lid 160 (upper opening/closing lid 162) and the edge portion 211*a* of the connection duct 211, the gap therebetween is closed by the protruding piece 171 of the covering sheet 170 laid therebetween. Hence, the developer G that moves from the opening/closing lid 160 (upper opening/closing lid 162) toward the edge portion of the connection port 212 of the connection duct 211 may rarely fall from the gap therebetween.

Figure 17:
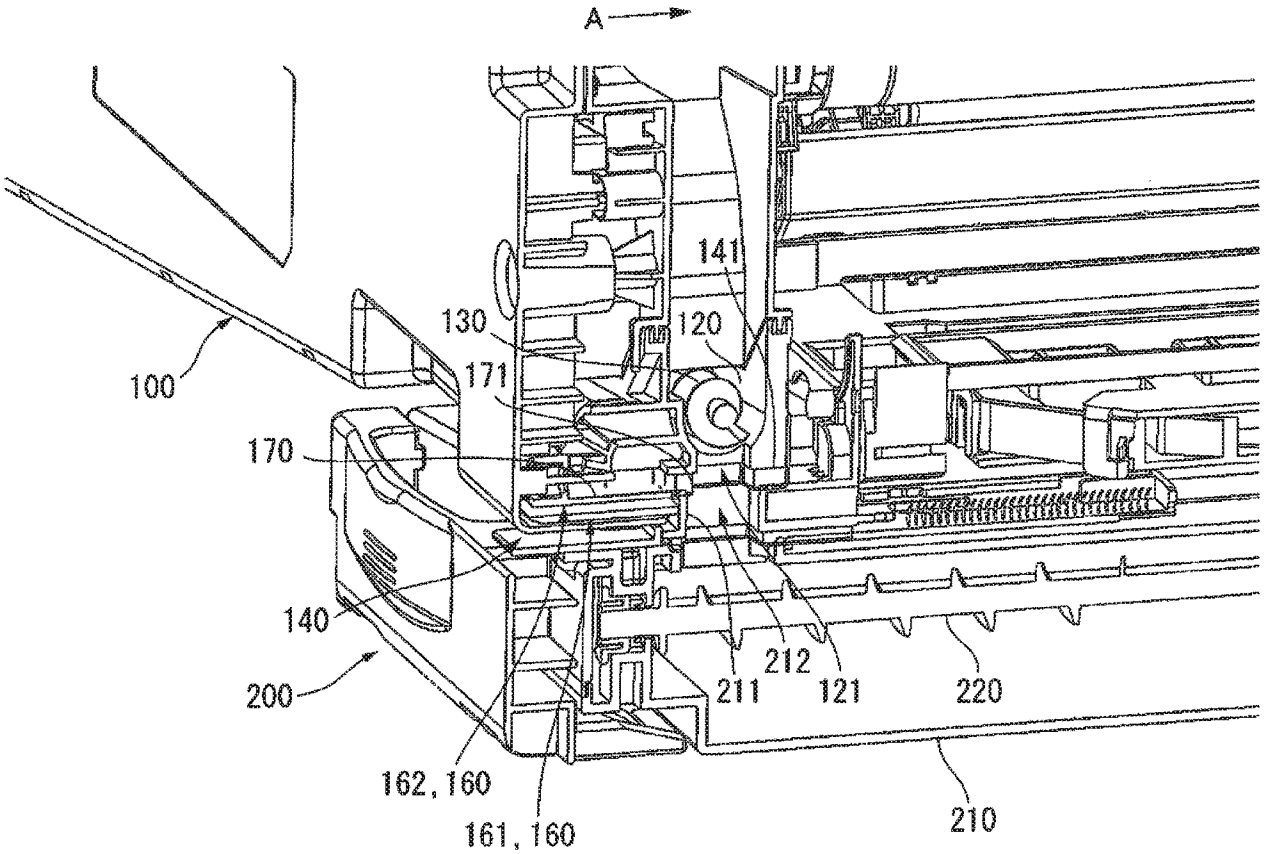
FIG. 17 illustrates an operation process (5) of the shutter mechanism.
Figure 19G:
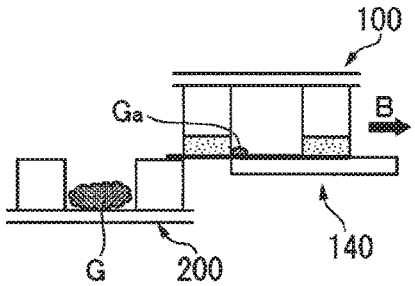
Figure 19D:
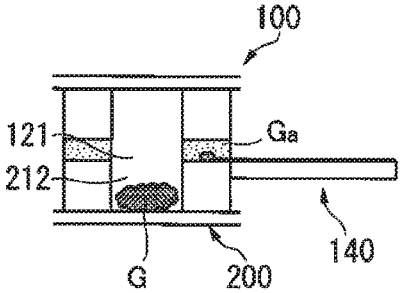

As illustrated in FIGS. 17 and 19D, when the developer transport unit 100 reaches the set position, the discharging port 121 of the shutter mechanism 140 is brought into a state completely communicating with the connection port 212 of the connection duct 211 in the developer collection box 200. The developer G that moves from the opening/closing lid 160 (upper opening/closing lid 162) along the edge portion of the connection port 212 in the connection duct 211 is scraped by the seal member 141, and drops from the connection port 212. At this time, since the covering sheet 170 is a thin sheet in the first exemplary embodiment, a stepped portion is rarely formed between the edge portion of the connection port 212 of the connection duct 211 and the protruding piece 171 of the covering sheet 170. Hence, most of the developer G that moves from the protruding piece 171 of the covering sheet 170 over the edge portion of the connection port 212 drops from the connection port 212. A small part Ga of the developer G may remain because there is a minute stepped portion in a portion of the edge portion of the connection port 212 in the connecting duct 211 at the distal end of the protruding piece 171 of the covering sheet 170. However, since the remaining developer part Ga is kept elastically biased by the seal member 141, it may hardly scatter around.

When Developer Transport Unit is Detached

The developer transport unit 100 is detached from the set position in the apparatus housing 21 after drawn out in a direction of arrow B, as illustrated in FIGS. 19E to 19H.

Figure 19H:
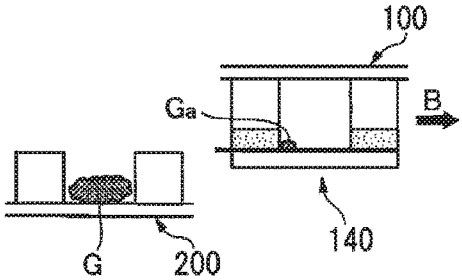

At this time, when the developer transport unit 100 moves in the direction of arrow B, as illustrated in FIGS. 19E and 19F, the seal member 141 in the shutter mechanism 140 moves from the edge portion of the connection port 212 of the connection duct 211, passes over the protruding piece 171 of the covering sheet 170, and moves in contact with the opening/closing lid 160 (upper opening/closing lid 162) while being elastically biased toward the opening/closing lid 160 (upper opening/closing lid 162). Hence, the developer part Ga remaining in the edge portion of the connection port 212 is scraped off by the seal member 141. When the developer transport unit 100 further moves in the direction of arrow B, as illustrated in FIG. 19G, the above-described developer part Ga is returned into the developer transport unit 100 at the time when the discharging port 121 of the seal member 141 reaches the position closed by the opening/closing lid 160 (upper opening/closing lid 162). For this reason, the developer part Ga may hardly remain in the edge portion of the connection port 212 in the connection duct 211. When the developer transport unit 100 is further moved in this state, as illustrated in FIG. 19H, the opening/closing lid 160 (upper opening/closing lid 162) in the shutter mechanism 140 separates from the connection duct 211 in the developer collection box 200. This allows the developer transport unit 100 to be detached from the apparatus housing 21.

Next, shutter mechanisms 240 and 340 according to first and second comparative examples will be described to evaluate performance of the shutter mechanism 140 of the first exemplary embodiment.

First Comparative Example

Figure 20A:
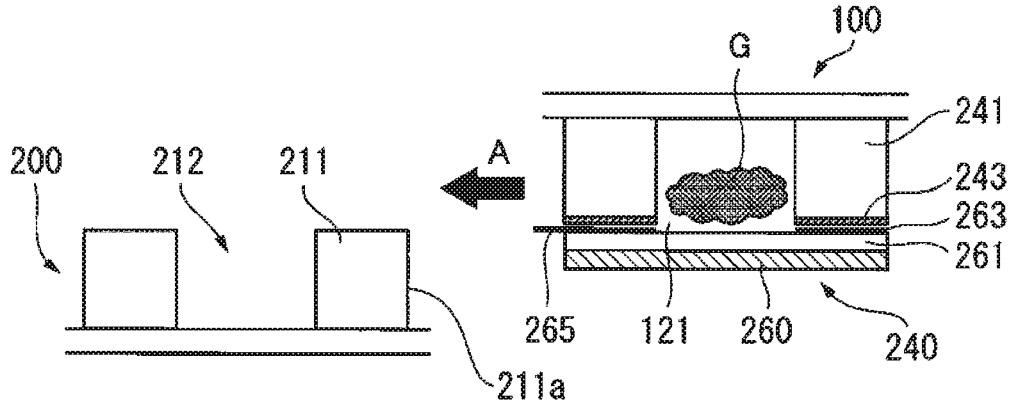
FIG. 20A is an explanatory view schematically illustrating the principal part of a shutter mechanism according to a first comparative example.

FIG. 20A illustrates a shutter mechanism 240 according to the first comparative example.

Referring to FIG. 20A, in the shutter mechanism 240, a discharging port 121 of a container body 241 in a developer transport unit 100 is opened and closed by an opening/closing lid 260, and a covering sheet 243 formed of, for example, Mylar (trademark) is provided in an edge portion of the discharging port 121. A side of the opening/closing lid 260 opposed to the discharging port 121 is provided with a front layer 261 formed of a material having a relatively low sliding resistance such as urethane rubber. A covering sheet 263 formed of, for example, Mylar (trademark) is provided on a portion of the front layer 261 of the opening/closing lid 260 corresponding to the covering sheet 243 provided in the edge portion of the discharging port 121. Further, one of the covering sheets, that is, the covering sheet 263 has a protruding piece 265 that protrudes from an end portion of the opening/closing lid 260 toward a connection port 212 of a connection duct 211 in a developer collection box 200.

The shutter mechanism 240 of the first comparative example exhibits the following behavior.

Figure 21A:
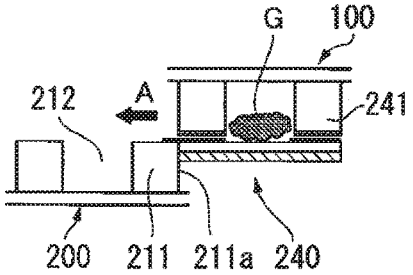
FIGS. 21A to 21D are explanatory view illustrating the behavior of the shutter mechanism from a closing position to an open position when a developer transport unit is attached in the first comparative example.
Figure 21E:
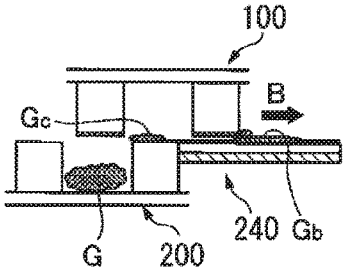
FIGS. 21E to 21H are explanatory views illustrating the behavior of the shutter mechanism from the open position to the closing position when the developer transport unit is detached in the first comparative example.
Figure 21B:
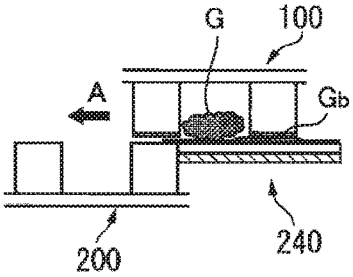
Figure 21F:
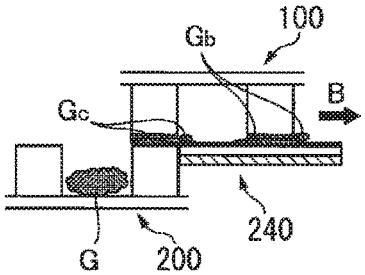
Figure 21C:
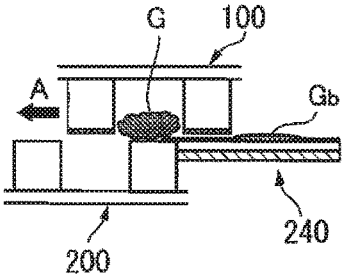
Figure 21G:
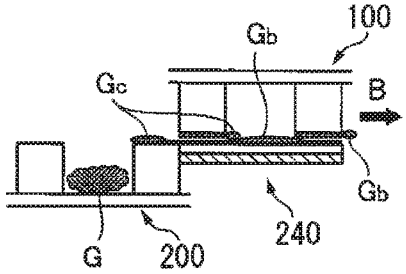
Figure 21D:
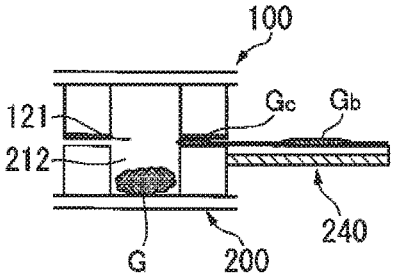
Figure 21H:
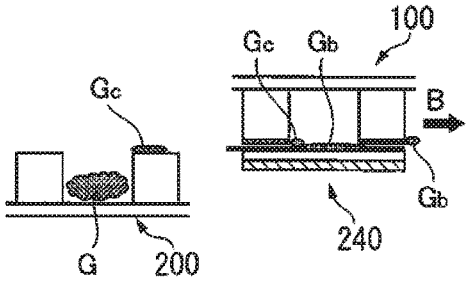

To be attached in a set position in an apparatus housing 21, as illustrated in FIGS. 21A to 21D, the developer transport unit 100 is moved in the direction of arrow A to reach the set position (corresponding to FIG. 21D in the first comparative example).

At this time, as illustrated in FIG. 21A, when the opening/closing lid 260 collides with an edge portion 211*a* of the connection duct 211 in the developer collection box 200, since the protruding piece 265 of the covering sheet 263 on the opening/closing lid 260 is disposed in contact with an edge portion of the connection port 212 of the connection duct 211, even when there is a minute gap in a contact portion between the opening/closing lid 260 and the edge portion 211*a* of the connection duct 211, the gap is closed by the protruding piece 265. Hence, developer G may be prevented from falling from the gap when passing therethrough.

For this reason, when the container body 241 further moves in the direction of arrow A in the state in which the opening/closing lid 260 abuts on the edge portion 211*a* of the connection duct 211, as illustrated in FIGS. 21B to 21D, most of the developer G inside the container body 241 drops from the connection port 212 of the developer collection box 200 via the covering sheet 263 and the protruding piece 265 of the opening/closing lid 260 and the edge portion of the connection port 212.

However, in the first comparative example, when the shutter mechanism 240 is put in the open state, as illustrated in FIG. 21D, it stops at the position where the covering sheet 243 of the container body 241 and the covering sheet 263 of the opening/closing lid 260 are in contact with each other. Since the surfaces of the covering sheet 243 and the covering sheet 263 are both smooth, a part Gb of the developer is apt to remain therebetween.

Further, since the smoothness of the front layer 261 between the opening/closing lid 260 and the covering sheet 263 is lower than that of the covering sheet 263, a part Gc of the developer is apt to adhere to the front layer 261. For this reason, when the container body 241 further moves in the direction of arrow A, as illustrated in FIGS. 21B and 21C, the covering sheet 243 of the container body 241 moves in contact with the developer part Gc adhering to the opening/closing lid 260. However, since the surface of the covering sheet 243 is smooth, the developer part Gc adhering to the opening/closing lid 260 passes over the covering sheet 263, and may scatter in a state in which an inner surface of the opening/closing lid 260 is exposed outside.

As illustrated in FIGS. 21E to 21H, when the developer transport unit 100 is moved in the direction of arrow B to be detached from the set position in the apparatus housing 21, the developer part Gb remaining between the covering sheets 243 and 263 in the shutter mechanism 240 is apt to remain in the edge portion of the connection port 212 of the connection duct 211 even when the container body 241 moves, because the surface of the covering sheet 243 of the container body 241 is smooth. Further, the developer part Gc remaining on the opening/closing lid 260 may be partly returned into the container body 241 along with the movement of the container body 241, but may fall because it is scraped by the outer edge portion of the container body 241.

Second Comparative Example

Figure 20B:
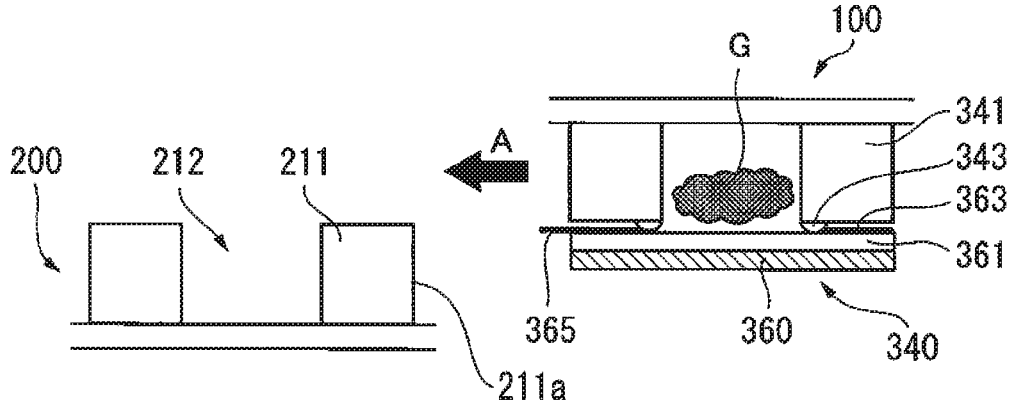
FIG. 20B is an explanatory view schematically illustrating the principal part of a shutter mechanism according to a second comparative example.

FIG. 20B illustrates a shutter mechanism 340 according to a second comparative example.

Referring to FIG. 20B, in the shutter mechanism 340, a discharging port 121 of a container body 341 in a developer transport unit 100 is opened and closed by an opening/closing lid 360, and a projecting portion 343 projecting toward the opening/closing lid 360 is provided in a peripheral edge portion of the discharging port 121 of the container body 341. A front layer 361 formed of a material having a relatively low sliding resistance, such as urethane rubber, is provided on a side of the opening/closing lid 360 opposed to the discharging port 121. On a portion of the front layer 361 of the opening/closing lid 360 except for the projecting portion 343 at the discharging port 121, a covering sheet 363 formed of, for example, Mylar (trademark) is provided. Further, the covering sheet 363 has a protruding piece 365 that protrudes from an end portion of the opening/closing lid 360 toward a connection port 212 of a connection duct 211 in a developer collection box 200.

The shutter mechanism 340 according to the second comparative example exhibits the following behavior.

To be attached at a set position in an apparatus housing 21, the developer transport unit 100 is moved in the direction of arrow A until it reaches the set position (corresponding to FIG. 22D in the second comparative example), as illustrated in FIGS. 22A to 22D.

Figure 22A:
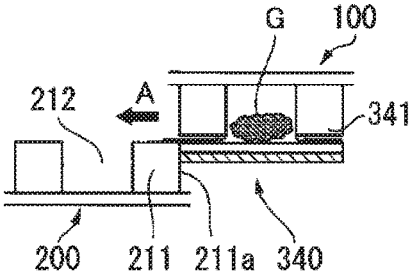
FIGS. 22A to 22D are explanatory views illustrating the behavior of the shutter mechanism from a closing position to an open position when a developer transport unit is attached in the second comparative example.

At this time, as illustrated in FIG. 22A, when the opening/closing lid 360 collides with an edge portion 211*a* of the connection duct 211 in the developer collection box 200, the protruding piece 365 of the covering sheet 363 on the opening/closing lid 360 is disposed in contact with an edge portion of the connection port 212 in the connection duct 211, similarly to the first comparative example. When the container body 341 further moves in the direction of arrow A in the state in which the opening/closing lid 360 abuts on the edge portion 211*a* of the connection duct 211, as illustrated in FIGS. 22B to 22D, most developer G inside the container body 341 drops from the connection port 212 of the developer collection box 200 via the covering sheet 363 and the projecting piece 365 of the opening/closing lid 360, and the edge portion of the connection port 212.

Figure 22B:
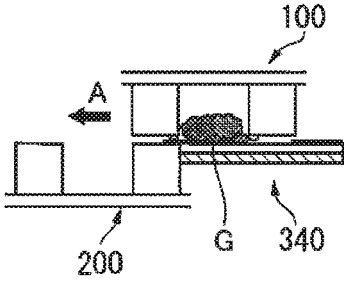
Figure 22C:
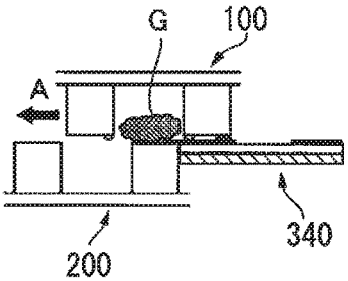
Figure 22D:
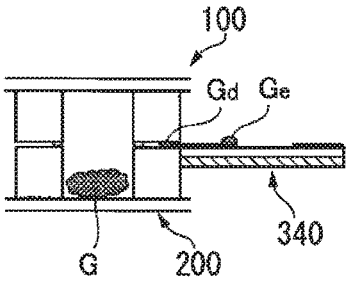
Figure 22E:
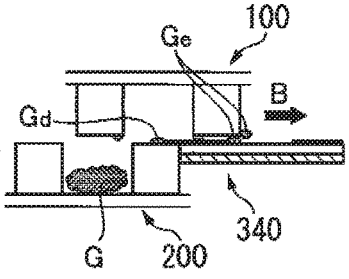
FIGS. 22E to 22H are explanatory views illustrating the behavior of the shutter mechanism from the open position to the closing position when the developer transport unit is detached in the second comparative example.
Figure 22F:
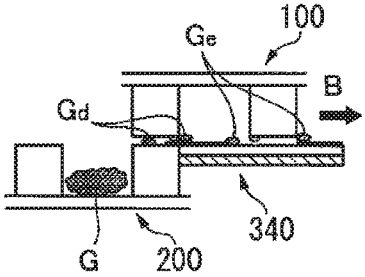
Figure 22G:
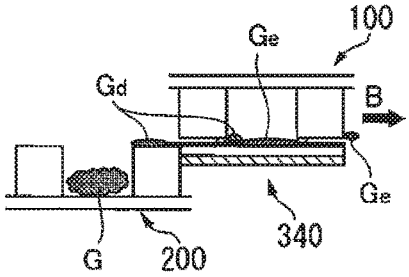
Figure 22H:
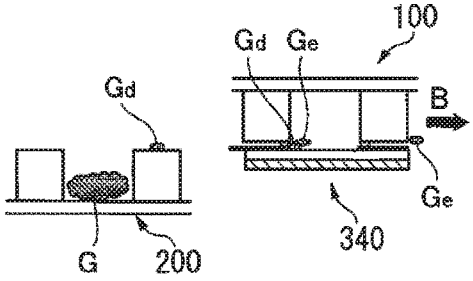

In the second comparative example, however, as illustrated in FIG. 22D, when the opening/closing lid 360 is put in an open state, if there is a gap between the container body 341 and the covering sheet 363 in the state in which the projecting portion 343 of the container body 341 is in contact with the edge portion of the connection port 212, a developer part Gd is apt to remain in the gap.

When the container body 341 moves, as illustrated in FIGS. 22B to 22D, the projecting portion 343 of the container body 341 moves the developer G on the opening/closing lid 360. When the projecting portion 343 runs onto the covering sheet 363 of the opening/closing lid 360, a developer part Gd passes between the projecting portion 343 and the covering sheet 363, and a developer part Ge adhering to the opening/closing lid 360 may scatter in a state in which an inner surface of the opening/closing lid 360 is exposed outside.

As illustrated in FIGS. 22E to 22H, when the developer transport unit 100 is moved in the direction of arrow B to be detached from the set position in the apparatus housing 21, the developer part Gd remaining in the edge portion of the connection port 212 in the connection duct 211 may not be completely scraped by the projecting portion 343 of the container body 341, but may remain in the edge portion of the connection duct 211 because the contact resistance between the projecting portion 343 and the covering sheet 363 of the opening/closing lid 360 is low when the projecting portion 343 moves on the covering sheet 363.

Further, the developer part Ge remaining on the opening/closing lid 360 may be partly returned into the container body 341 along with the movement of the container body 341, but may fall because it is scraped by an outer edge portion of the container body 241.

While the present invention is applicable to the shutter mechanism that opens and closes the gap between the developer transport unit and the developer collection box, as in the first exemplary embodiment, it is not limited to this shutter mechanism. For example, the present invention may be applied to a shutter mechanism in a developer cartridge serving as a supply system for toner and developer to supply the toner and the developer to a developer supply unit in an apparatus housing.

Further, the present invention is widely applicable to a shutter mechanism of a powder transport container provided between the powder transport container and a powder receiving container, and the powder to be used is not limited to toner and developer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An opening/closing mechanism provided between a powder transport container that is removably attached to an apparatus housing of a powder processing apparatus including a powder processing unit, has a discharging port opening downward, and is configured to transport powder toward the discharging port and a powder receiving container that is provided in the apparatus housing, has a connection port opening upward, and is configured to receive the powder in the powder transport container dropped as a result of the connection port communicating with the discharging port, the opening/closing mechanism being configured to open and close the discharging port along with attachment and detachment of the powder transport container, the opening/closing mechanism comprising:

an opening/closing lid configured to open and close the discharging port while being held to linearly move along an edge of the discharging port and configured to open the discharging port by being stopped by a part of the powder receiving container when the powder transport container is attached to the apparatus housing;

a seal member formed of an elastically deformable elastic material in a peripheral edge portion of the discharging port to seal a gap between the seal member and the opening/closing lid; and a covering material that is provided on a surface of the opening/closing lid opposed to the seal member and has a surface smoother than at least a surface of the seal member, wherein the covering material has a protrusion that protrudes from the opening/closing lid toward the connection port and is disposed to be in contact with an edge portion of the connection port when the powder transport container is attached to the apparatus housing.

2. The opening/closing mechanism according to claim 1, wherein the protrusion of the covering material has a thickness of 300 μm or less.

3. The opening/closing mechanism according to claim 1, wherein the protrusion of the covering material is configured to be guided in contact with an inclined surface of the edge portion that inclines obliquely downward with increasing distance from the connection port.

4. A powder transport device comprising:

a powder transport container that is removably attached to an apparatus housing of a powder processing apparatus, has a discharging port opening downward, and is configured to transport powder toward the discharging port; and an opening/closing mechanism configured to open and close the discharging port along with attachment and detachment of the powder transport container, wherein the powder transport device is configured such that the powder in the powder transport container dropped as a result of the discharging port communicating with a connection port opening upward in a powder receiving container provided in the apparatus housing is received in the powder receiving container, wherein the opening/closing mechanism includes:

an opening/closing lid configured to open and close the discharging port while being held to linearly move along an edge of the discharging port and configured to open the discharging port by being stopped by a part of the powder receiving container when the powder transport container is attached to the apparatus housing, a seal member formed of an elastically deformable elastic material in a peripheral edge portion of the discharging port to seal a gap between the seal member and the opening/closing lid, and a covering material that is provided on a surface of the opening/closing lid opposed to the seal member and has a surface smoother than at least a surface of the seal member, and wherein the covering material has a protrusion that protrudes from the opening/closing lid toward the connection port and is disposed to be in contact with the edge portion of the connection port when the powder transport container is attached to the apparatus housing.

5. A powder processing apparatus comprising:

a powder transport container that is removably attached to an apparatus housing of the powder processing apparatus, has a discharging port opening downward, and is configured to transport powder toward the discharging port;

a powder receiving container that is provided in the apparatus housing, has a connection port opening upward, and is configured to receive the powder in the powder transport container dropped as a result of the connection port communicating with the discharging port; and an opening/closing mechanism configured to open and close the discharging port along with attachment and detachment of the powder transport container, wherein the opening/closing mechanism includes:

an opening/closing lid configured to open and close the discharging port while being held to linearly move along an edge of the discharging port and opens the discharging port by being stopped by a part of the powder receiving container when the powder transport container is attached to the apparatus housing, a seal member formed of an elastically deformable elastic material in a peripheral edge portion of the discharging port to seal a gap between the seal member and the opening/closing lid, and a covering material that is provided on a surface of the opening/closing lid opposed to the seal member and has a surface smoother than at least a surface of the seal member, and wherein the covering material has a protrusion that protrudes from the opening/closing lid toward the connection port and is disposed to be in contact with the edge portion of the connection port when the powder transport container is attached to the apparatus housing.

* * * * *